US009696073B2

(12) United States Patent
Noboa et al.

(10) Patent No.: US 9,696,073 B2
(45) Date of Patent: Jul. 4, 2017

(54) FAULT DETECTION AND DIAGNOSTIC SYSTEM FOR A REFRIGERATION CIRCUIT

(71) Applicant: Johnson Controls Technology Company, Holland, MI (US)

(72) Inventors: Homero L. Noboa, Waukesha, WI (US); Andrew J. Boettcher, Wauwatosa, WI (US); Saman Beyhaghi, Hartford, WI (US)

(73) Assignee: Johnson Controls Technology Company, Holland, MI (US)

( * ) Notice: Subject to any disclaimer, the term of this patent is extended or adjusted under 35 U.S.C. 154(b) by 350 days.

(21) Appl. No.: 14/572,375

(22) Filed: Dec. 16, 2014

(65) Prior Publication Data

US 2016/0169572 A1 Jun. 16, 2016

(51) Int. Cl.

| | |
|---|---|
| ***F25B 49/02*** | (2006.01) |
| ***F25B 49/00*** | (2006.01) |
| ***F25B 13/00*** | (2006.01) |
| ***F25B 25/00*** | (2006.01) |

(52) U.S. Cl.

CPC ..... *F25B 49/005* (2013.01); *F25B 13/00* (2013.01); *F25B 25/005* (2013.01); *F25B 2339/047* (2013.01); *F25B 2700/1931* (2013.01); *F25B 2700/1933* (2013.01); *F25B 2700/21151* (2013.01); *F25B 2700/21152* (2013.01)

(58) Field of Classification Search

CPC F25B 49/005; F25B 49/02; F25B 2700/1931; F25B 2700/1933; F25B 2700/21151; F25B 2700/21152; F25B 2700/21173

USPC ..... 61/126, 127, 129

See application file for complete search history.

(56) References Cited

U.S. PATENT DOCUMENTS

| | | | | |
|---|---|---|---|---|
| 4,301,660 | A | 11/1981 | Mueller et al. | |
| 6,711,445 | B1 | 3/2004 | Heath et al. | |
| 7,490,477 | B2 | 2/2009 | Singh et al. | |
| 7,845,179 | B2 | 12/2010 | Singh et al. | |
| 9,574,572 | B2 * | 2/2017 | Andersen | F04D 27/0246 |
| 2007/0089440 | A1 * | 4/2007 | Singh | F25B 49/005 62/129 |
| 2008/0077260 | A1 | 3/2008 | Porter et al. | |
| 2011/0174059 | A1 * | 7/2011 | Yonemori | F25B 49/005 73/40 |

(Continued)

*Primary Examiner* — Marc Norman
(74) *Attorney, Agent, or Firm* — Foley & Lardner LLP

(57) ABSTRACT

A fault detection and diagnostics (FDD) system is provided for a refrigeration circuit having an evaporator and a compressor configured to circulate a refrigerant through the evaporator. The FDD system includes a communications interface configured to receive a measurement of a thermodynamic property affected by the refrigeration circuit and a processing circuit having a processor and memory. The processing circuit is configured to use the measured thermodynamic property to determine an expected suction entropy of the refrigerant at a suction of the compressor, use the expected suction entropy to determine an expected thermodynamic discharge property of the refrigerant at a discharge of the compressor, determine an actual thermodynamic discharge property of the refrigerant at the discharge of the compressor, and detect a fault in the refrigeration circuit by comparing the expected thermodynamic discharge property with the actual thermodynamic discharge property.

20 Claims, 13 Drawing Sheets

(56) References Cited

U.S. PATENT DOCUMENTS

| | | | | |
|---|---|---|---|---|
| 2013/0340457 | A1 | 12/2013 | Keres et al. | |
| 2014/0163744 | A1 | 6/2014 | Dolcich et al. | |
| 2014/0214365 | A1* | 7/2014 | Ligeret ..... | G01M 99/005<br>702/183 |

* cited by examiner

FAULT DETECTION AND DIAGNOSTIC SYSTEM FOR A REFRIGERATION CIRCUIT

BACKGROUND

The present invention relates generally to a fault detection and diagnostics (FDD) system. The present invention relates more particularly to a FDD system configured to detect and diagnose faults in a refrigeration circuit. The refrigeration circuit may be implemented in a building management system or separate from a building management system.

A building management system (BMS) is, in general, a system of devices configured to control, monitor, and manage equipment in or around a building or building area. A BMS can include a heating, ventilation, and air conditioning (HVAC) system, a security system, a lighting system, a fire alerting system, another system that is capable of managing building functions or devices, or any combination thereof. BMS devices may be installed in any environment (e.g., an indoor area or an outdoor area) and the environment may include any number of buildings, spaces, zones, rooms, or areas. A BMS may include METASYS building controllers or other devices sold by Johnson Controls, Inc., as well as building devices and components from other sources.

Fault detection is an element of some building management systems. Equipment faults increase energy consumption, decrease equipment lifespans and cause other undesirable effects. In some buildings, chillers (e.g., fluid coolers, refrigeration units, etc.) are the single largest energy consumers in the building. Consequently, chiller performance may have a direct and significant impact on overall building energy consumption and efficiency. Traditional fault detection and diagnostic systems evaluate chiller performance by monitoring chiller energy consumption and/or observing a downstream effect that the chiller has on the building environment or other building equipment. It is difficult and challenging to develop fault detection strategies for chillers and other equipment in building management systems.

SUMMARY

As used herein, the term "thermodynamic property" (or simply "property") may refer to any quantifiable attribute of a substance or material that can be used to describe the substance or material in a given state. For example, thermodynamic properties may include temperature, pressure, enthalpy, entropy, internal energy, density, specific volume, quality, or any other attribute that can be used to describe a substance or material. Some thermodynamic properties may be measured directly (e.g., using various sensors), whereas other thermodynamic properties may be estimated, calculated from measured/estimated values, or otherwise determined according to the systems and methods described herein. Two or more thermodynamic properties may characterize a thermodynamic state.

As used herein, the term "thermodynamic state" (or simply state) may refer to an actual thermodynamic state (e.g., based on actual/measured thermodynamic properties), an estimated thermodynamic state (e.g., based on estimated thermodynamic properties), and/or an idealized thermodynamic state (e.g., based on idealized or isentropic thermodynamic properties) of a refrigerant in a refrigeration circuit. A thermodynamic state may be defined at a given location in the refrigeration circuit (e.g., a suction state, a discharge state, etc.) and may be characterized by two or more thermodynamic properties of the refrigerant at the given location. Advantageously, the systems and methods of the present disclosure use thermodynamic properties and/or states affected by a refrigeration circuit (e.g., properties/states of a refrigerant used in the refrigeration circuit, properties/states of a fluid cooled by the refrigeration circuit, etc.) to detect and diagnose faults in the refrigeration circuit.

One implementation of the present disclosure is a fault detection and diagnostics (FDD) system for a refrigeration circuit. The refrigeration circuit includes an evaporator and a compressor configured to circulate a refrigerant through the evaporator. The FDD system includes a communications interface configured to receive a measurement of a thermodynamic property affected by the refrigeration circuit and a processing circuit having a processor and memory. The processing circuit is configured to use the measured thermodynamic property to determine an expected suction entropy of the refrigerant at a suction of the compressor and to use the expected suction entropy to determine an expected thermodynamic discharge property of the refrigerant at a discharge of the compressor. The processing circuit is further configured to determine an actual thermodynamic discharge property of the refrigerant at the discharge of the compressor and to detect a fault in the refrigeration circuit by comparing the expected thermodynamic discharge property with the actual thermodynamic discharge property.

In some embodiments, the refrigerant absorbs heat from a secondary fluid in the evaporator and the measured thermodynamic property is a measured temperature of the secondary fluid downstream of the evaporator. Determining the expected suction entropy may include using the measured temperature of the secondary fluid and an expected approach of the evaporator to determine an expected suction temperature of the refrigerant at the suction of the compressor. The expected suction entropy may correspond to a saturated vapor state of the refrigerant at the expected suction temperature.

In some embodiments, the communications interface is configured to receive a measured discharge pressure of the refrigerant at the discharge of the compressor. Determining the expected thermodynamic discharge property may include using the measured discharge pressure and the expected suction entropy to calculate an isentropic discharge temperature of the refrigerant at the discharge of the compressor.

In some embodiments, determining the expected thermodynamic discharge property includes calculating an expected suction enthalpy corresponding to a saturated vapor state of the refrigerant at the expected suction temperature and using the isentropic discharge temperature and the measured discharge pressure to calculate an isentropic discharge enthalpy of the refrigerant at the discharge of the compressor.

In some embodiments, determining the expected thermodynamic discharge property includes identifying an isentropic efficiency of the compressor. The processing circuit may use the expected suction enthalpy, the isentropic discharge enthalpy, and the isentropic efficiency to calculate an expected discharge enthalpy of the refrigerant at the discharge of the compressor. The processing circuit may use the expected discharge enthalpy and the measured discharge pressure to calculate an expected discharge temperature of the refrigerant at the discharge of the compressor.

In some embodiments, the expected thermodynamic discharge property is an expected discharge temperature at a discharge pressure, the actual thermodynamic discharge property is a measured discharge temperature at the discharge pressure, and detecting the fault in the refrigeration circuit includes comparing the expected discharge temperature with the measured discharge temperature.

In some embodiments, the expected thermodynamic discharge property is an expected amount of superheat corresponding to a difference between an expected discharge temperature of the refrigerant and a saturation temperature of the refrigerant at a measured discharge pressure, the actual thermodynamic discharge property is an actual amount of superheat corresponding to a difference between a measured discharge temperature of the refrigerant and the saturation temperature of the refrigerant at the measured discharge pressure, and detecting the fault in the refrigeration circuit includes comparing the expected amount of superheat with the actual amount of superheat.

In some embodiments, detecting the fault in the refrigeration circuit includes calculating an amount by which the actual thermodynamic discharge property (e.g., temperature or amount of superheat) exceeds the expected thermodynamic discharge property (e.g., temperature or amount of superheat), comparing the calculated amount with a threshold value, and determining that an evaporator fouling fault is detected in response to the calculated amount exceeding the threshold value.

In some embodiments, the measured thermodynamic property is a measured suction temperature or pressure of the refrigerant at the suction of the compressor. Determining the expected suction entropy may include calculating an expected entropy corresponding to a saturated vapor state of the refrigerant at the measured suction temperature or pressure.

In some embodiments, the expected thermodynamic discharge property is an isentropic discharge property resulting from an ideal isentropic compression of the refrigerant from a saturated vapor at the suction of the compressor to superheated vapor at the discharge of the compressor. The actual discharge property may be based on a measured discharge temperature of the refrigerant at the discharge of the compressor. Detecting the fault in the refrigeration circuit may include comparing the isentropic discharge property with the actual discharge property.

In some embodiments, detecting the fault in the refrigeration circuit includes determining that a liquid carryover fault is detected in response to the isentropic discharge property exceeding the actual discharge property.

Another implementation of the present disclosure is a fault detection and diagnostics (FDD) system for a refrigeration circuit. The refrigeration circuit includes an evaporator and a compressor configured to circulate a refrigerant through the evaporator. The FDD system includes a communications interface configured to receive measurements from one or more sensors positioned to measure a thermodynamic suction property (e.g., pressure, temperature, etc.) of the refrigerant at a suction of the compressor and a thermodynamic discharge property (e.g., pressure, temperature, etc.) of the refrigerant at a discharge of the compressor. The FDD system further includes a processing circuit having a processor and memory. The processing circuit is configured to use the measured thermodynamic properties to calculate enthalpy values including an actual suction enthalpy of the refrigerant at the suction of the compressor, an actual discharge enthalpy of the refrigerant at the discharge of the compressor, and an isentropic discharge enthalpy of the refrigerant at the discharge of the compressor. The processing circuit is configured to use the calculated enthalpy values to calculate an isentropic efficiency of the compressor, identify a threshold isentropic efficiency of the compressor, and detect a fault in the refrigeration circuit by comparing the calculated isentropic efficiency with the threshold isentropic efficiency.

In some embodiments, the measurements from the one or more sensors include a measured suction temperature or pressure of the refrigerant at the suction of the compressor, a measured discharge pressure of the refrigerant at the discharge of the compressor, and a measured discharge temperature of the refrigerant at the discharge of the compressor.

In some embodiments, calculating the isentropic efficiency of the compressor includes calculating a suction enthalpy and a suction entropy corresponding to a saturated vapor state of the refrigerant at the measured suction temperature or pressure, using the suction entropy and the measured discharge pressure to calculate an isentropic discharge enthalpy at the discharge of the compressor, and using the measured discharge pressure and the measured discharge temperature to calculate an actual discharge enthalpy at the discharge of the compressor.

In some embodiments, calculating the isentropic efficiency of the compressor includes determining a first amount by which the isentropic discharge enthalpy exceeds the suction enthalpy, determining a second amount by which the actual discharge enthalpy exceeds the suction enthalpy, and dividing the first amount by the second amount.

Another implementation of the present disclosure is a method for detecting and diagnosing faults in a refrigeration circuit. The refrigeration circuit includes an evaporator and a compressor configured to circulate a refrigerant through the evaporator. Various steps of the method may be performed by a processing circuit of a fault detection and diagnostics (FDD) system. The method includes receiving a measurement of a thermodynamic property affected by the refrigeration circuit, using the measured thermodynamic property to determine an expected suction entropy of the refrigerant at a suction of the compressor, using the expected suction entropy of the refrigerant at the suction of the compressor to determine an expected thermodynamic discharge property of the refrigerant at a discharge of the compressor, determining an actual thermodynamic discharge property of the refrigerant at the discharge of the compressor, and detecting a fault in the refrigeration circuit by comparing the expected thermodynamic discharge property with the actual thermodynamic discharge property.

In some embodiments, detecting the fault in the refrigeration circuit includes calculating an amount by which the actual thermodynamic discharge property (e.g., temperature, degrees of superheat, etc.) exceeds the expected thermodynamic discharge property (e.g., temperature, degrees of superheat, etc.), comparing the calculated amount with a threshold value, and determining that an evaporator fouling fault is detected in response to the calculated amount exceeding the threshold value.

In some embodiments, determining the expected thermodynamic discharge property includes calculating an isentropic discharge property (e.g., temperature, degrees of superheat, etc.) resulting from an ideal isentropic compression of the refrigerant from a saturated vapor at the suction of the compressor to a superheated vapor at the discharge of the compressor. In some embodiments, determining the actual discharge property (e.g., temperature, degrees of superheat, etc.) includes using a measured discharge temperature of the refrigerant at the discharge of the compressor. In some embodiments, detecting the fault in the refrigeration circuit includes determining that a liquid carryover fault is detected in response to the isentropic discharge property exceeding the actual discharge property.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
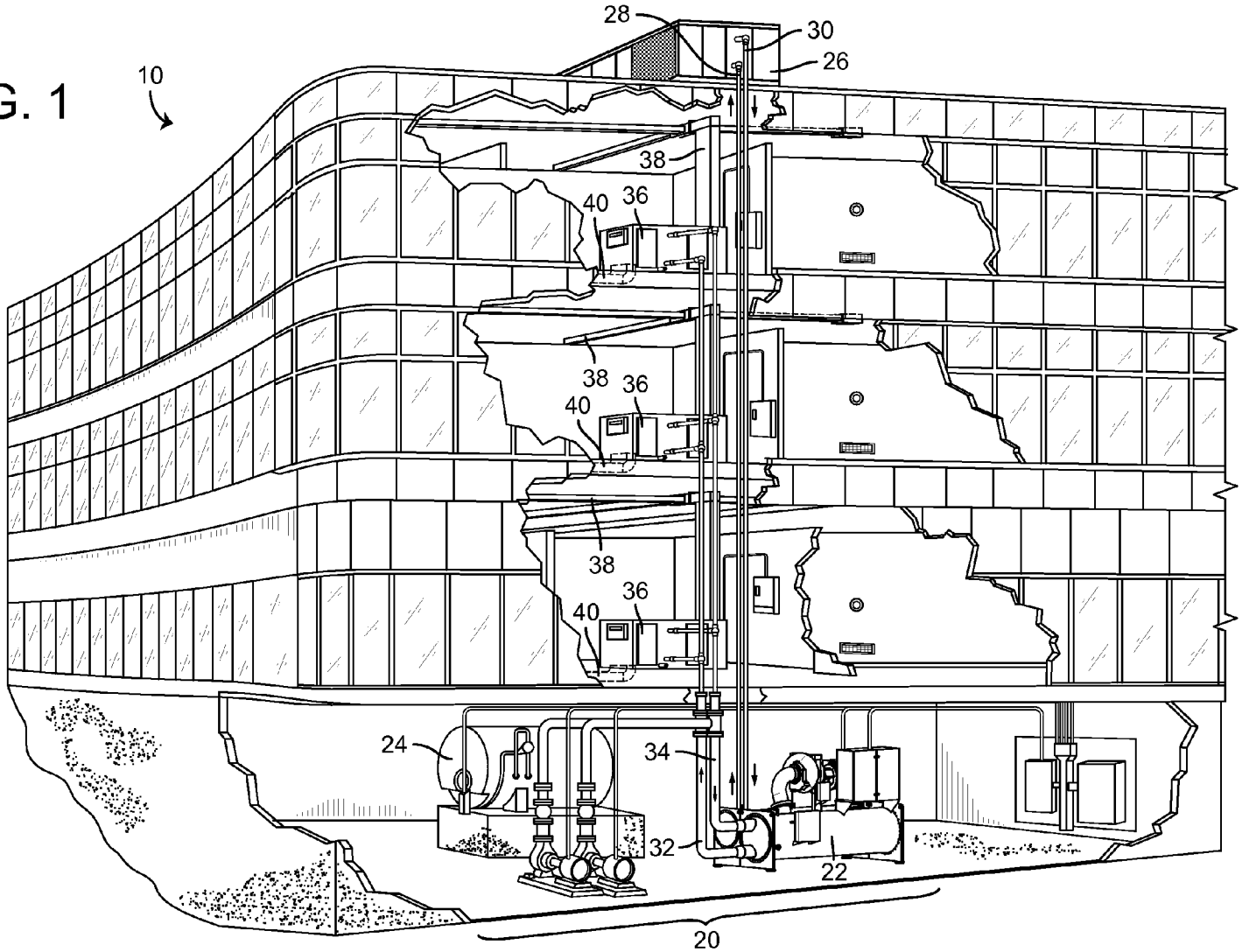
FIG. 1 a perspective view of a building serviced by a heating, ventilation, and air conditioning system (HVAC) system, according to an exemplary embodiment.

Referring generally to the FIGURES, systems and methods for detecting and diagnosing faults in a refrigeration circuit are shown, according to various exemplary embodiments. The systems and methods described herein may be used to detect and diagnose faults in a chiller or other equipment in a refrigeration circuit (e.g., compressors, condensers, evaporators, heat exchangers, etc.) using predicted and/or measured thermodynamic properties (e.g., temperature, pressure, entropy, enthalpy, quality, etc.). The thermodynamic properties may be properties of a refrigerant used by the refrigeration circuit and/or properties of a separate fluid in heat exchange relation with the refrigerant. A fault detection and diagnostics (FDD) system may use the thermodynamic properties to detect and diagnose faults in the refrigeration circuit.

One fault that may be detected by the FDD system is an evaporator fouling fault. Evaporator fouling may occur when the thermal resistance of the evaporator increases (e.g., due to corrosion, chemical damage, accumulation of precipitants or particulate matter in the evaporator, etc.), thereby reducing the evaporator's heat transfer coefficient and inhibiting heat transfer to the refrigerant flowing through the evaporator. For the refrigerant to absorb the required amount of heat in the evaporator, the temperature and pressure of the refrigerant in the evaporator may decrease. Such a reduction of evaporating pressure may increase the pressure lift required by the compressor, resulting in additional power consumption and reducing the energy efficiency of the refrigeration circuit.

The FDD system may detect the evaporator fouling fault by comparing a measured temperature of the refrigerant at an outlet of the compressor (i.e., a measured discharge temperature) with an expected temperature of the refrigerant at the outlet of the compressor (i.e., an expected discharge temperature). If the measured discharge temperature exceeds the expected discharge temperature by a threshold value, the FDD system may determine that the evaporator fouling fault is detected. In other embodiments, the FDD system may detect evaporator fouling fault by comparing an amount of superheat of the refrigerant at the compressor outlet (i.e., the measured discharge temperature minus the saturation temperature of the refrigerant at the compressor discharge pressure) with a threshold value. If the amount of superheat exceeds the threshold value, the FDD system may determine that the evaporator fouling fault is detected.

In some embodiments, the FDD system calculates the expected discharge temperature by determining an isentropic temperature of the refrigerant at the outlet of the compressor (i.e., an isentropic discharge temperature) and applying an isentropic efficiency of the compressor. In other embodiments, the FDD system uses the isentropic discharge temperature as the expected discharge temperature. The FDD system may determine the isentropic discharge temperature based on a measured or calculated property of the refrigerant at the compressor inlet (e.g., suction pressure, suction enthalpy, etc.) and a measured or calculated property of the refrigerant at the compressor outlet (e.g., discharge pressure, discharge enthalpy, etc.). An exemplary method for detecting the evaporator fouling fault is described in greater detail below.

Another fault that may be detected by the FDD system is a compressor efficiency fault. The FDD system may detect the compressor efficiency fault by comparing a calculated compressor efficiency (e.g., an isentropic efficiency) with a threshold value (e.g., a previously-determined compressor efficiency, a manufacturer-provided efficiency, etc.). If the calculated compressor efficiency is less than the threshold value by a predetermined amount, the FDD system may determine that the compressor efficiency fault is detected.

The isentropic efficiency of the compressor may be defined as the ratio of the change in refrigerant enthalpy resulting from an isentropic compression from the suction pressure to the discharge pressure to the change in refrigerant enthalpy resulting from the actual compression from the suction pressure to the discharge pressure. The thermodynamic properties of the refrigerant may be measured at the inlet and outlet of the compressor and used to calculate the isentropic efficiency. An exemplary method for detecting the compressor efficiency fault is described in greater detail below.

Another fault that may be detected by the FDD system is a liquid carryover fault. The liquid carryover fault may occur when the evaporator is not able to evaporate the entire refrigerant flow, which results in the carryover of some liquid refrigerant to the compressor. In the compressor, the liquid refrigerant may convert to vapor while the compression process is occurring. When the refrigerant is a mixture of liquid and vapor, the temperature and pressure remain fixed at the saturation values. This fact makes detecting liquid at the suction of the compressor impossible by means of temperature and/or pressure sensors at the compressor suction alone. However, thermodynamic properties of the refrigerant at the compressor discharge can be used to detect the liquid carryover fault.

The FDD system may detect the liquid carryover fault by comparing a measured temperature of the refrigerant at an outlet of the compressor (i.e., a measured discharge temperature) with an expected temperature of the refrigerant at the outlet of the compressor (i.e., an expected discharge temperature). If the measured discharge temperature is less than the expected discharge temperature, the FDD system may determine that the liquid carryover fault is detected. The expected discharge temperature may be, for example, an isentropic discharge temperature resulting from an ideal isentropic compression of a saturated vapor. Due to the second law of thermodynamics, the actual discharge temperature of the refrigerant cannot be less than the isentropic discharge temperature if the refrigerant is indeed a saturated vapor at the suction of the compressor. Therefore, a measured discharge temperature less than the isentropic discharge temperature indicates that the refrigerant was not fully evaporated at the suction of the compressor.

In other embodiments, the FDD system may detect the liquid carryover fault by comparing an amount of superheat of the refrigerant at the compressor outlet (i.e., the measured discharge temperature minus the saturation temperature of the refrigerant at the compressor discharge pressure) with a threshold value. The threshold value may be, for example, an expected amount of superheat resulting from an isentropic compression from the suction pressure to the discharge pressure when the refrigerant enters the compressor as a saturated vapor. If the amount of superheat is less than the threshold value, the FDD system may determine that the liquid carryover fault is detected. An exemplary method for detecting the liquid carryover fault is described in greater detail below.

In various embodiments, the FDD system may be a component of a local controller for a chiller or refrigeration circuit (e.g., an embedded chiller controller), a supervisory controller (e.g., a HVAC system controller, a BMS controller, etc.) in communication with the chiller or refrigeration circuit components via a local communications network (e.g., a BACnet network, a LAN, etc.), an enterprise-level controller (e.g., a remote controller, a cloud-based controller, etc.), server, a client device, a portable communications device, or any other computer system or device in communication with the chiller or refrigeration circuit components via a communications network (e.g., the Internet, a WAN, a cellular network, etc.), or any combination thereof In any embodiment, the FDD system may receive thermodynamic property information from the chiller or refrigeration circuit via sensors configured to measure various thermodynamic properties of the refrigerant (e.g., pressure, temperature, etc.) and/or a fluid chilled by the refrigerant. The measured thermodynamic properties may be used to calculate other thermodynamic properties (e.g., enthalpy, entropy, degrees of superheat, quality, etc.) at various locations within the refrigeration circuit (e.g., compressor suction or inlet, compressor discharge or outlet, chilled fluid outlet, etc.) to facilitate the fault detection and diagnostic processes described herein.

Referring now to FIG. 1, a perspective view of a building 10 is shown. Building 10 is serviced by a heating, ventilation, and air conditioning system (HVAC) system 20. HVAC system 20 is shown to include a chiller 22, a boiler 24, a rooftop cooling unit 26, and a plurality of air-handling units (AHUs) 36. HVAC system 20 uses a fluid circulation system to provide heating and/or cooling for building 10. The circulated fluid may be cooled in chiller 22 or heated in boiler 24, depending on whether cooling or heating is required. Boiler 24 may add heat to the circulated fluid by burning a combustible material (e.g., natural gas). Chiller 22 may place the circulated fluid in a heat exchange relationship with another fluid (e.g., a refrigerant) in a heat exchanger (e.g., an evaporator). The refrigerant removes heat from the circulated fluid during an evaporation process, thereby cooling the circulated fluid.

The circulated fluid from chiller 22 or boiler 24 may be transported to AHUs 36 via piping 32. AHUs 36 may place the circulated fluid in a heat exchange relationship with an airflow passing through AHUs 36. For example, the airflow may be passed over piping in fan coil units or other air conditioning terminal units through which the circulated fluid flows. AHUs 36 may transfer heat between the airflow and the circulated fluid to provide heating or cooling for the airflow. The heated or cooled air may be delivered to building 10 via an air distribution system including air supply ducts 38 and may return to AHUs 36 via air return ducts 40. HVAC system 20 is shown to include a separate AHU 36 on each floor of building 10. In other embodiments, a single AHU (e.g., a rooftop AHU) may supply air for multiple floors or zones. The circulated fluid from AHUs 36 may return chiller 22 or boiler 24 via piping 34.

In some embodiments, the refrigerant in chiller 22 is vaporized upon absorbing heat from the circulated fluid. The vapor refrigerant may be provided to a compressor within chiller 22 where the temperature and pressure of the refrigerant are increased (e.g., using a rotating impeller, a screw compressor, a scroll compressor, a reciprocating compressor, a centrifugal compressor, etc.). The compressed refrigerant may be discharged into a condenser within chiller 22. In some embodiments, water (or another fluid) flows through tubes in the condenser of chiller 22 to absorb heat from the refrigerant vapor, thereby causing the refrigerant to condense. The water flowing through tubes in the condenser may be pumped from chiller 22 to a cooling unit 26 via piping 28. Cooling unit 26 may use fan driven cooling or fan driven evaporation to remove heat from the water. The cooled water from cooling unit 26 may be delivered back to chiller 22 via piping 30 and the cycle repeats.

Figure 2:
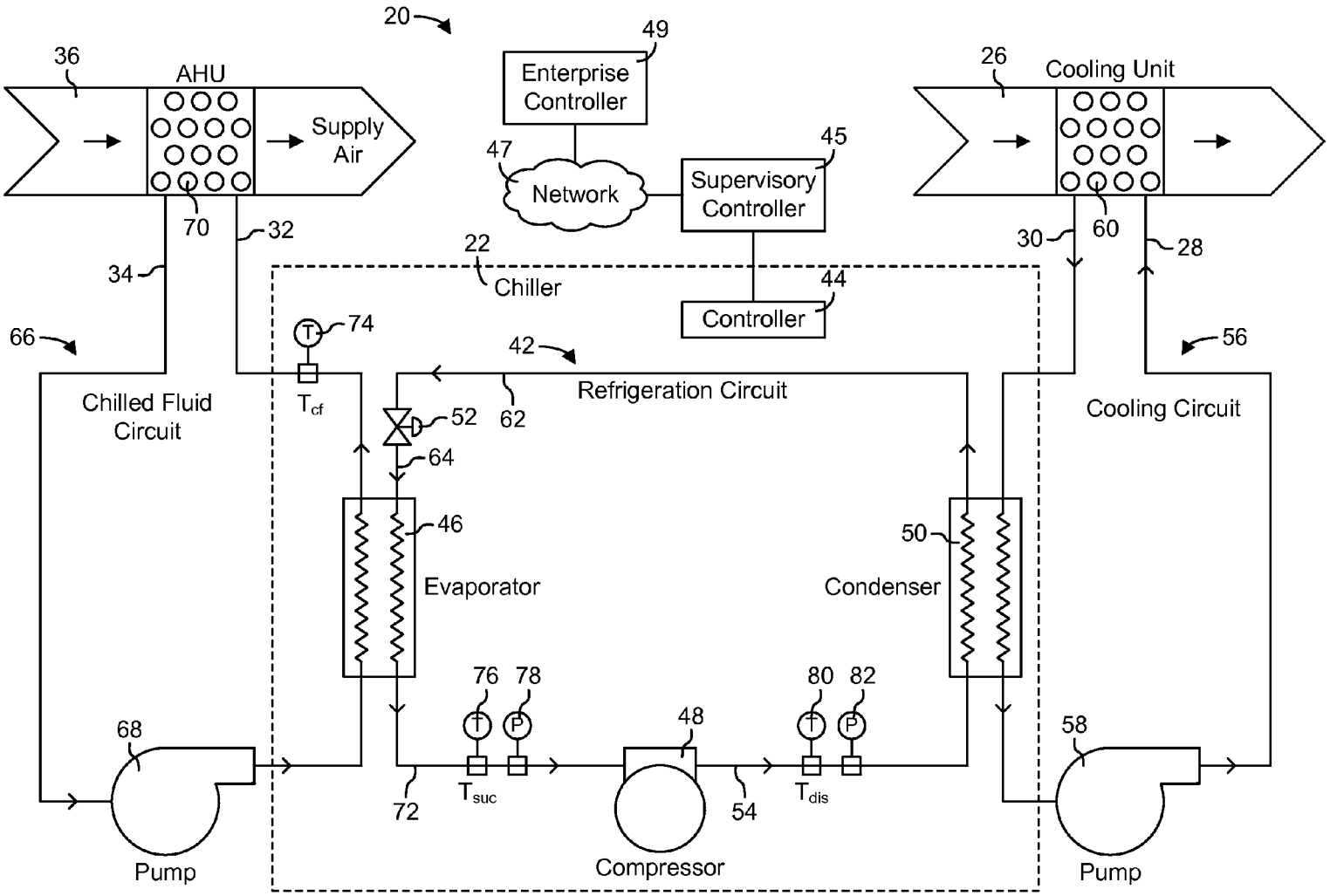
FIG. 2 is a block diagram illustrating a portion of the HVAC system of FIG. 1 in greater detail, showing a refrigeration circuit configured to circulate a refrigerant between an evaporator and a condenser, according to an exemplary embodiment.

Referring now to FIG. 2, a block diagram illustrating a portion of HVAC system 20 in greater detail is shown, according to an exemplary embodiment. In FIG. 2, chiller 22 is shown to include a refrigeration circuit 42 and a controller 44. Refrigeration circuit 42 is shown to include an evaporator 46, a compressor 48, a condenser 50, and an expansion valve 52. Compressor 48 may be configured to circulate a refrigerant through refrigeration circuit 42. In some embodiments, compressor 48 is operated by controller 44. Compressor 48 may compress the refrigerant to a high pressure, high temperature state and discharge the compressed refrigerant into a compressor discharge line 54 connecting the outlet of compressor 48 to the inlet of condenser 50.

Condenser 50 may receive the compressed refrigerant from discharge line 54. Condenser 50 may also receive a separate heat exchange fluid from cooling circuit 56 (e.g., water, a water-glycol mixture, another refrigerant, etc.). Condenser 50 may be configured to transfer heat from the compressed refrigerant to the heat exchange fluid, thereby causing the compressed refrigerant to condense from a gaseous refrigerant to a liquid or mixed fluid state. In some embodiments, cooling circuit 56 is a heat recovery circuit configured to use the heat absorbed from the refrigerant for heating applications. In other embodiments, cooling circuit 56 includes a pump 58 for circulating the heat exchange fluid between condenser 50 and cooling tower 26. Cooling unit 26 may include cooling coils 60 configured to facilitate heat transfer between the heat exchange fluid and another fluid (e.g., air) flowing through cooling unit 26. In other embodiments, cooling unit 26 may be a cooling tower. The heat exchange fluid may reject heat in cooling unit 26 and return to condenser 50 via piping 30.

Still referring to FIG. 2, refrigeration circuit 42 is shown to include a line 62 connecting an outlet of condenser 50 to an inlet of expansion device 52. Expansion device 52 may be configured to expand the refrigerant in refrigeration circuit 42 to a low temperature and low pressure state. Expansion device 52 may be a fixed position device or variable position device (e.g., a valve). Expansion device 52 may be actuated manually or automatically (e.g., by controller 44 via a valve actuator) to adjust the expansion of the refrigerant passing therethrough. Expansion device 52 may output the expanded refrigerant into line 64 connecting an outlet of expansion device 52 to an inlet of evaporator 46.

Evaporator 46 may receive the expanded refrigerant from line 64. Evaporator 46 may also receive a separate chilled fluid from chilled fluid circuit 66 (e.g., water, a water-glycol mixture, another refrigerant, etc.). Evaporator 46 may be configured to transfer heat from the chilled fluid to the expanded refrigerant in refrigeration circuit 42, thereby cooling the chilled fluid and causing the refrigerant to evaporate. In some embodiments, chilled fluid circuit 66 includes a pump 68 for circulating the chilled fluid between evaporator 46 and AHU 36. AHU 36 may include cooling coils 70 configured to facilitate heat transfer between the chilled fluid and another fluid (e.g., air) flowing through AHU 36. The chilled fluid may absorb heat in AHU 36 and return to evaporator 46 via piping 34. Evaporator 46 may output the heated refrigerant to suction line 72 connecting the outlet of evaporator 46 with the inlet of compressor 48.

Evaporator 46 may have an expected approach $EA_{exp}$ based on manufacturer specifications or prior operating data. The expected approach $EA_{exp}$ may be defined as the expected difference between the temperature $T_{cf}$ of the chilled fluid in circuit 66 at the outlet of evaporator 46 (i.e., the temperature of the chilled fluid in piping 32) and the temperature $T_{suc}$ of the refrigerant in circuit 42 at the suction of compressor 48 (i.e., the temperature of the refrigerant in suction line 72). The temperature $T_{cf}$ of the chilled fluid in piping 32 may be measured by a temperature sensor 74 positioned along piping 32. The temperature $T_{suc}$ of the refrigerant in suction line 72 may be measured by a temperature sensor 76 positioned along suction line 72. Refrigeration circuit 42 may also include a pressure sensor 78 configured to measure the pressure of the refrigerant in suction line 72, a temperature sensor 80 configured to measure the temperature of the refrigerant in discharge line 54, and a pressure sensor 82 configured to measure the pressure of the refrigerant in discharge line 54.

Controller 44 may receive measurement inputs from sensors 74-82 and use the inputs to detect and diagnose faults in refrigeration circuit 42. Controller 44 may be an embedded controller for chiller 22 configured to control the components of refrigeration circuit 42. For example, controller 44 may activate/deactivate compressor 48 and open/close expansion device 52. Controller 44 may be configured to determine thermodynamic properties of the refrigerant at various locations within refrigeration circuit 42 based on the inputs from sensors 74-82. For example, controller 44 may calculate non-measured thermodynamic properties (e.g., enthalpy, entropy, etc.) of the refrigerant in suction line 72, discharge line 54, and/or other locations within refrigeration circuit 42.

Controller 44 may perform fault detection and diagnostics locally and/or communicate the measured and calculated thermodynamic values to an upstream controller (e.g., a supervisory controller 45, an enterprise controller 49, etc.) or computer system for system-level or enterprise-level fault detection and diagnostics. Supervisory controller 45 may be connected with controller 44 via a local network (e.g., a LAN, a BACnet network, etc.) whereas enterprise controller 49 may be connected with supervisory controller 45 and controller 44 via a remote network 47 (e.g., a WAN, the Internet, a cellular network, etc.).

Figure 3:
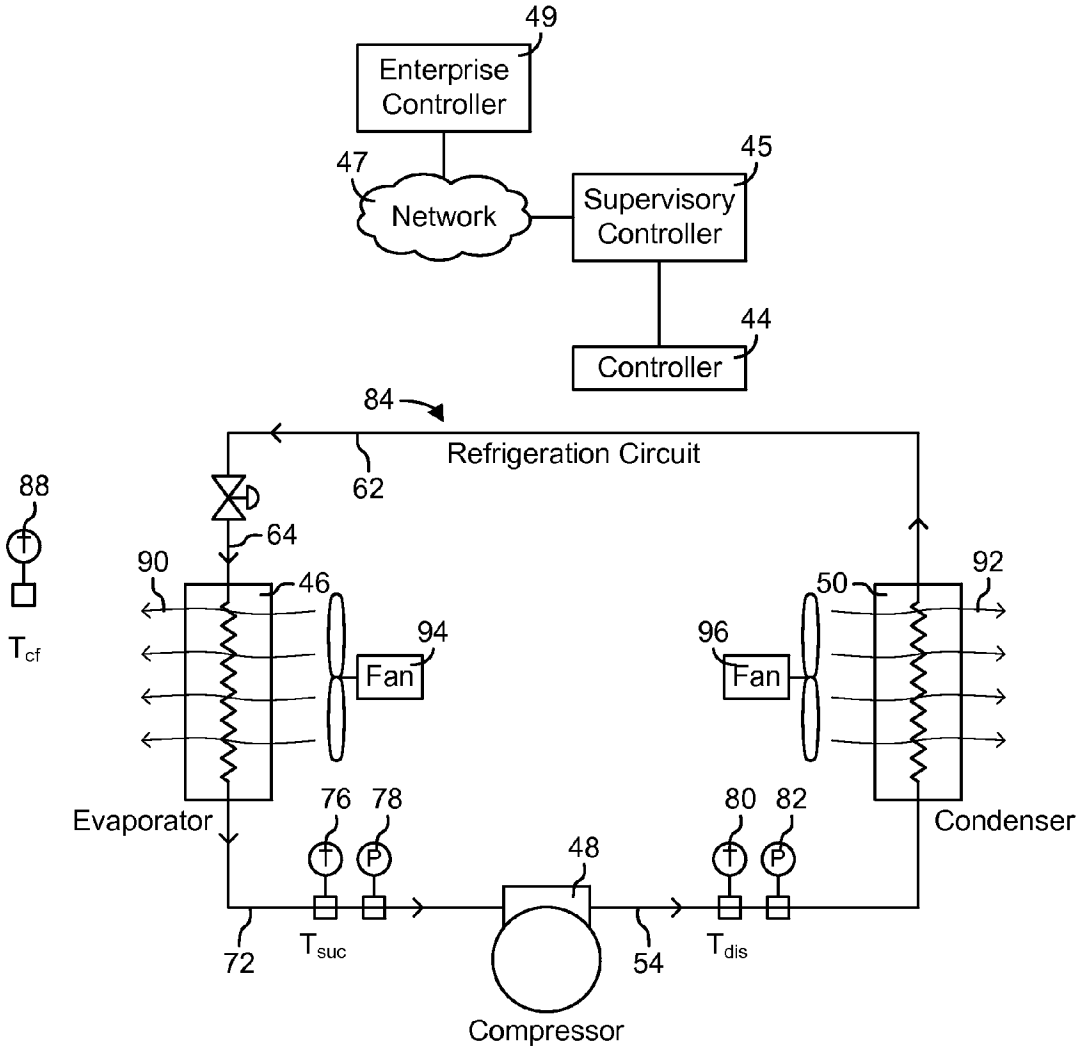
FIG. 3 is a block diagram illustrating an alternative implementation of the refrigeration circuit of FIG. 2, according to an exemplary embodiment.

Referring now to FIG. 3, another refrigeration circuit 84 is shown, according to an exemplary embodiment. Refrigeration circuit 84 may be the same or similar to refrigeration circuit 42 as described with reference to FIG. 2, but implemented in a more general setting. For example, refrigeration circuit 84 is shown to include evaporator 46, compressor 48, condenser 50, expansion device 52, discharge line 54, line 62, line 64, suction line 72, sensors 76-78 positioned along suction line 72, and sensors 80-82 positioned along discharge line 54. Refrigeration circuit 84 may be implemented in a chiller (e.g., chiller 22) or used in a various other refrigeration systems or devices such as refrigerators, freezers, refrigerated display cases, refrigerated storage devices, product coolers, standalone air conditioners, or any other system or device that provides cooling using a vapor-compression refrigeration loop.

In refrigeration circuit 84, evaporator 46 is shown absorbing heat from an airflow 90 forced through or across evaporator 46 by a fan 94. Similarly, condenser 50 is shown rejecting heat to an airflow 92 forced through or across condenser 50 by a fan 96. Fans 94 and 96 may be controlled by controller 86 to modulate the rate of heat transfer in evaporator 46 and condenser 50, respectively. In some embodiments, fans 94-96 are variable speed fans capable of operating at multiple different speeds. Controller 86 may increase or decrease the speed of fans 94-96 in response to various inputs from refrigeration circuit 84 (e.g., temperature measurements, pressure measurements, etc.).

Refrigeration circuit 84 is shown to include a temperature sensor 88 positioned within airflow 90 downstream of evaporator 46. Temperature sensor 88 may be configured to measure the temperature of airflow 90 after airflow 90 is chilled by evaporator 46. In some embodiments, controller 86 uses the temperature of airflow 90 measured by temperature sensor 88 as the chilled fluid temperature $T_{cf}$ for fault detection and diagnostics. In other embodiments, refrigeration circuit 84 exchanges heat with one or more closed fluid circuits (e.g., chilled fluid circuit 66, cooling circuit 56, etc.)

as described with reference to FIG. 2. In such embodiments, controller 86 may receive a measurement of a chilled fluid temperature.

Controller 86 may receive measurement inputs from sensors 76-82 and 88 and use the inputs to detect and diagnose faults in refrigeration circuit 84. Controller 86 may be an embedded controller for refrigeration circuit 84 configured to control the components of refrigeration circuit 84. For example, controller 86 may activate/deactivate compressor 48 and open/close expansion valve 52. Controller 86 may be configured to determine thermodynamic properties of the refrigerant at various locations within refrigeration circuit 84 based on the inputs from sensors 76-82 and 88. For example, controller 86 may calculate non-measured thermodynamic properties (e.g., enthalpy, entropy, etc.) of the refrigerant in suction line 72, discharge line 54, and/or other locations within refrigeration circuit 42.

Controller 86 may perform fault detection and diagnostics locally and/or communicate the measured and calculated thermodynamic values to an upstream controller (e.g., a supervisory controller 45, an enterprise controller 49, etc.) or computer system for system-level or enterprise-level fault detection and diagnostics. Supervisory controller 45 may be connected with controller 86 via a local network (e.g., a LAN, a BACnet network, etc.) whereas enterprise controller 49 may be connected with supervisory controller 45 and controller 86 via a remote network 47 (e.g., a WAN, the Internet, a cellular network, etc.).

Figure 4:
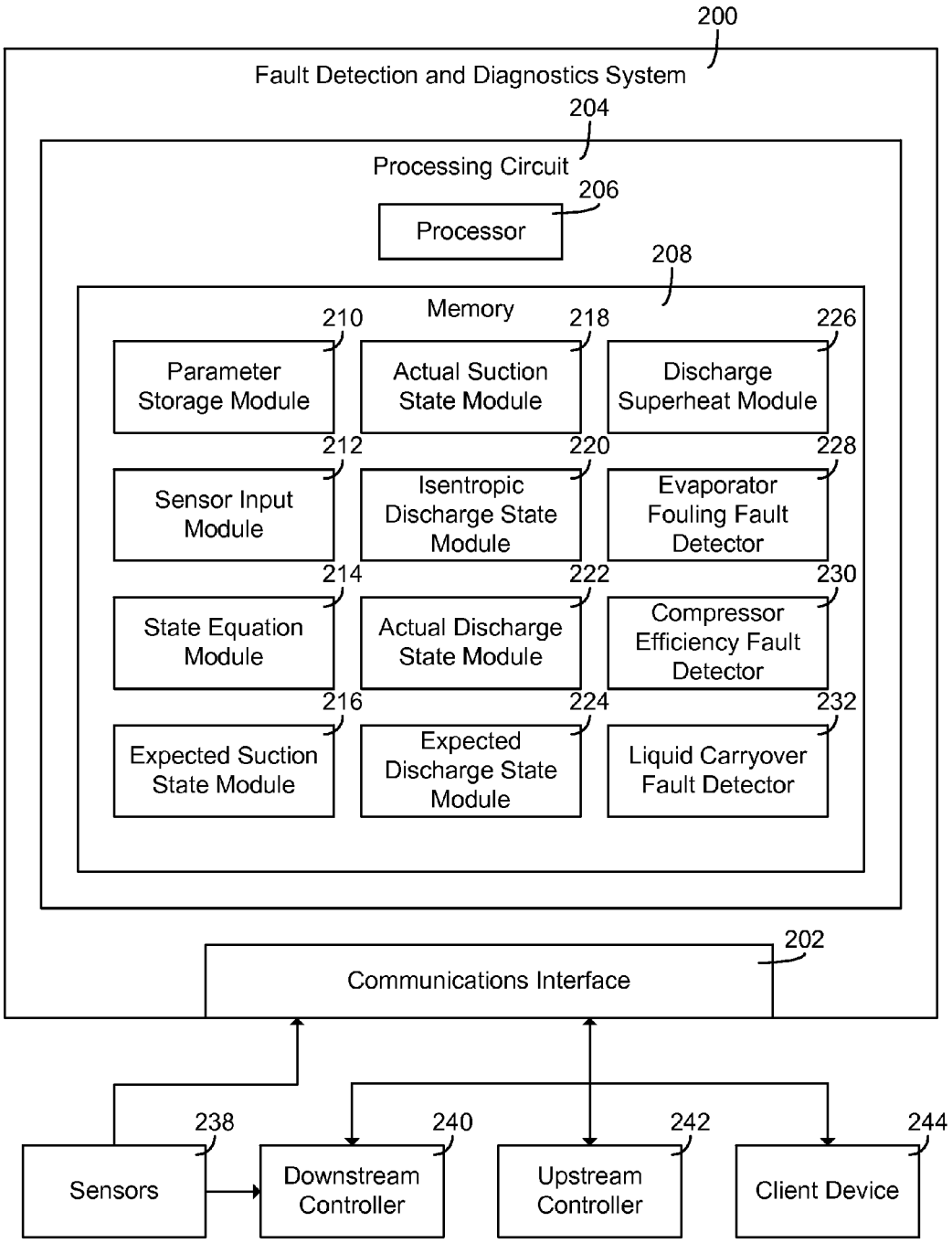
FIG. 4 is a block diagram of a fault detection and diagnostics (FDD) system that may be used to detect and diagnose faults in the refrigeration circuits of FIGS. 2-3, according to an exemplary embodiment.

Referring now to FIG. 4, a block diagram of a fault detection and diagnostics (FDD) system 200 is shown, according to an exemplary embodiment. In various embodiments, FDD system 200 may be a component of chiller controller 44 (shown in FIG. 2), refrigeration circuit controller 86 (shown in FIG. 3), supervisory controller 45, enterprise controller 49, or another computer system configured to detect and diagnose faults using measured or calculated thermodynamic properties. In some embodiments, components or modules of FDD system 200 may be distributed across multiple computing systems or devices.

FDD system 200 is shown to include a communications interface 202 and a processing circuit 204. Communications interface 202 may include wired or wireless interfaces (e.g., jacks, antennas, transmitters, receivers, transceivers, wire terminals, etc.) for conducting data communications with various systems, devices, or networks. For example, communications interface 202 may include an Ethernet card and/or port for sending and receiving data via an Ethernet-based communications network. In some embodiments, communications interface 202 includes a wireless transceiver (e.g., a WiFi transceiver, a Bluetooth transceiver, a NFC transceiver, etc.) for communicating via a wireless communications network. Communications interface 202 may be configured to communicate via local area networks (e.g., a building LAN) and/or wide area networks (e.g., the Internet, a cellular network, a radio communication network, etc.) and may use a variety of communications protocols (e.g., BACnet, TCP/IP, point-to-point, etc.).

In some embodiments, communications interface 202 receives measurement inputs from sensors 238. Sensors 238 may include, for example, temperature sensor 74 configured to measure the temperature of the chilled fluid at the outlet of evaporator 46, temperature sensor 88 configured to measure the temperature of the chilled airflow 90 downstream of evaporator 46, temperature sensor 76 configured to measure the temperature of the refrigerant in compressor suction line 72, pressure sensor 78 configured to measure the pressure of the refrigerant in compressor suction line 72, temperature sensor 80 configured to measure the temperature of the refrigerant in compressor discharge line 54, and pressure sensor 82 configured to measure the pressure of the refrigerant in compressor discharge line 54. Communications interface 202 may receive sensor inputs directly from sensors 238, via a local or remote communications network, and/or via an intermediary downstream controller 240. For example, if FDD system 200 is implemented in supervisory controller 45 or enterprise controller 49, sensor inputs may be collected by a downstream controller 240 (e.g., chiller controller 44, refrigeration circuit controller 86, etc.) and forwarded to FDD system 200. In other embodiments, FDD system is implemented in chiller controller 44 or refrigeration circuit controller 86 and receives sensor inputs directly from sensors 238.

Communications interface 202 may enable communications between FDD system 200, downstream controller 240, an upstream controller 242 and/or a client device 244. For example, FDD system 200 may receive sensor inputs from downstream controller 240 via communications interface 202. FDD system 200 may use the sensor inputs to detect and diagnose faults and may report a result of the fault detection and diagnostics to upstream controller 242 or client device 244. Communications interface 202 may facilitate user interaction with FDD system 200 via client device 244. For example, FDD system may generate fault detection notifications (e.g., alerts, alarms, reports, etc.) and provide the fault detection notifications to client device 244 for presentation via a graphical user interface. Client device 244 may send commands to FDD system 200, query FDD system 200 for information, trigger a FDD process, view results of the FDD process, or otherwise interact with FDD system 200 via communications interface 202.

Still referring to FIG. 4, processing circuit 204 is shown to include a processor 206 and memory 208. Processor 206 may be a general purpose or specific purpose processor, an application specific integrated circuit (ASIC), one or more field programmable gate arrays (FPGAs), a group of processing components, or other suitable processing components. Processor 206 may be configured to execute computer code or instructions stored in memory 208 or received from other computer readable media (e.g., CDROM, network storage, a remote server, etc.) to perform one or more of the FDD processes described herein.

Memory 208 may include one or more data storage devices (e.g., memory units, memory devices, computer-readable storage media, etc.) configured to store data, computer code, executable instructions, or other forms of computer-readable information. Memory 208 may include random access memory (RAM), read-only memory (ROM), hard drive storage, temporary storage, non-volatile memory, flash memory, optical memory, or any other suitable memory for storing software objects and/or computer instructions. Memory 208 may include database components, object code components, script components, or any other type of information structure for supporting the various activities and information structures described in the present disclosure. Memory 208 may be communicably connected to processor 206 via processing circuit 204 and may include computer code for executing (e.g., by processor 206) one or more of the FDD processes described herein.

Still referring to FIG. 4, memory 208 is shown to include a parameter storage module 210. Parameter storage module 210 may be configured to store various parameters used by FDD system 200 to perform the FDD processes described herein. Parameters stored in parameter storage module 210 may include, for example, an expected approach $EA_{exp}$ of evaporator 46 and an isentropic efficiency $\eta_s$ of compressor 48. Expected approach $EA_{exp}$ and isentropic efficiency $\eta_s$ may be based on manufacturer's specifications or calculated from prior operating data (described in greater detail below).

In some embodiments, parameter storage module 210 stores measured variables representing thermodynamic properties of the refrigerant and/or the chilled fluid at various measurement locations in a refrigeration circuit. For example, parameter storage module 210 may store a temperature $T_{cf}$ of the chilled fluid measured by chilled fluid temperature sensor 74 or airflow temperature sensor 88. Parameter storage module 210 may store a temperature $T_{suc,act}$ of the refrigerant at the suction side of compressor 48 (e.g., measured by temperature sensor 76), a pressure $P_{suc,act}$ of the refrigerant at the suction side of compressor 48 (e.g., measured by pressure sensor 78), a temperature $T_{dis,act}$ of the refrigerant at the discharge side of compressor 48 (e.g., measured by temperature sensor 80), and a pressure $P_{dis,act}$ of the refrigerant at the discharge side of compressor 48 (e.g., measured by pressure sensor 82). Parameter storage module 210 may receive and store any value measured by sensors 238, as may be applicable for various types and locations of sensors 238.

Parameter storage module 210 may store calculated variables representing thermodynamic properties of the refrigerant at various locations in the refrigeration circuit. Calculated variables may include expected values, actual values, isentropic values, or any combination thereof. For example, the expected thermodynamic state of the refrigerant at the suction side of compressor 48 may be characterized by an expected temperature $T_{suc,exp}$, an expected pressure $P_{suc,exp}$, an expected enthalpy $h_{suc,exp}$ and/or an expected entropy $s_{suc,exp}$. The actual thermodynamic state of the refrigerant at the suction side of compressor 48 may be characterized by an actual temperature $T_{suc,act}$, an actual pressure $P_{suc,act}$, an actual enthalpy $h_{suc,act}$ and/or an actual entropy $s_{suc,act}$. The isentropic thermodynamic state of the refrigerant at the discharge side of compressor 48 may be characterized by an isentropic temperature $T_{dis,s}$, an isentropic pressure $P_{dis,s}$, an isentropic enthalpy $h_{dis,s}$, and/or an isentropic entropy $s_{dis,s}$. The expected thermodynamic state of the refrigerant at the discharge side of compressor 48 may be characterized by an expected temperature $T_{dis,exp}$, an expected pressure $P_{dis,exp}$, an expected enthalpy $h_{dis,exp}$, and/or an expected entropy $s_{dis,exp}$. The actual thermodynamic state of the refrigerant at the discharge side of compressor 48 may be characterized by an actual temperature $T_{dis,act}$, an actual pressure $P_{dis,act}$, an actual enthalpy $h_{dis,act}$, and/or an actual entropy $s_{dis,act}$. Parameter storage module 210 may store some or all of these values for use by the other modules of memory 208.

Still referring to FIG. 4, memory 208 is shown to include a sensor input module 212. Sensor input module 212 may obtain measured inputs from sensors 238 via communications interface 202, process the measured inputs, and store the processed inputs as measured values in parameter storage module 210. In some embodiments, sensor input module 212 converts raw sensor data into a form that can be used by other modules of memory 208. For example, sensor input module 212 may translate a raw voltage value from one of sensors 238 into units of temperature or pressure (e.g., according to a conversion chart or formula). Sensor input module 212 may be configured to convert an analog data signal into discrete data points (e.g., by sampling the analog signal at predetermined intervals), add timing information to the data points, and store the discrete data points in parameter storage module 210. In some embodiments, sensor input module 212 annotates each data point with an indication of the sensor from which the data point was obtained, a type of data point (e.g., temperature, pressure, quality, etc.), a time at which the data point was measured, and/or other information associated with the data point.

Variables generated by sensor input module 212 may include, for example, a temperature $T_{cf}$ of the chilled fluid measured by chilled fluid temperature sensor 74 or airflow temperature sensor 88, a temperature $T_{suc,act}$ of the refrigerant at the suction side of compressor 48 measured by temperature sensor 76, a pressure $P_{suc,act}$ of the refrigerant at the suction side of compressor 48 measured by pressure sensor 78, a temperature $T_{dis,act}$ of the refrigerant at the discharge side of compressor 48 measured by temperature sensor 80, and/or a pressure $P_{dis,act}$ of the refrigerant at the discharge side of compressor 48 measured by pressure sensor 82.

Still referring to FIG. 4, memory 208 is shown to include a state equation module 214. State equation module 214 may store state equations, charts, conversion formulas, tables, or other information that can be used to determine an unknown thermodynamic property of the refrigerant based on one or more known thermodynamic properties. For example, state equation module 214 may store a thermodynamic relationship that allows the actual entropy $s_{suc,act}$ of the refrigerant at the suction side of compressor 48 to be determined based on the actual temperature $T_{suc,act}$ and/or the actual pressure $P_{suc,act}$ at the suction side of compressor 48.

State equation module 214 may store state equations for determining an unknown property (e.g., entropy, enthalpy, temperature, pressure, etc.) of the refrigerant in a particular thermodynamic state as a function of one or more known properties (e.g., a measured or calculated pressure, temperature, enthalpy, entropy, etc.) at the same location in the refrigeration circuit. The state equations stored in state equation module 214 may be used by state modules 216-224 to determine expected, actual, and/or isentropic properties of the refrigerant at various locations within the refrigeration circuit.

Still referring to FIG. 4, memory 208 is shown to include an expected suction state module 216. Expected suction state module 216 may be configured to determine or calculate expected thermodynamic properties of the refrigerant at the suction side of compressor 48. For example, expected suction state module 216 may calculate an expected temperature $T_{suc,exp}$, an expected pressure $P_{suc,exp}$, an expected enthalpy $h_{suc,exp}$, and/or an expected entropy $s_{suc,exp}$ of the refrigerant at the suction side of compressor 48.

Expected suction state module 216 may calculate the expected temperature $T_{suc,exp}$ of the refrigerant at the suction side of compressor 48 using the equation:

$$T_{suc,exp}=T_{cf}-EA_{exp}$$

where $EA_{exp}$ is the expected approach for evaporator 46 and $T_{cf}$ is the measured temperature of the chilled fluid (e.g., air, water, or another fluid chilled by evaporator 46) leaving evaporator 46.

Expected suction state module 216 may determine the expected pressure $P_{suc,exp}$ and the expected entropy $s_{suc,exp}$ of the refrigerant at the suction side of compressor 48 using an assumption that the refrigerant is a saturated vapor at the outlet of evaporator 46 (i.e., quality=1). For example, expected suction state module 216 may calculate the expected pressure $P_{suc,exp}$ and the expected entropy $s_{suc,exp}$ using the equations:

$$P_{suc,exp}=P_{sat}(T_{suc,exp})$$

$$s_{suc,exp}=s_{sat}(T_{suc,exp})$$

where $P_{sat}$( ) and $s_{sat}$( ) are functions that return the saturation pressure and saturation entropy, respectively, of the refrigerant at a particular temperature provided as an input. In addition to temperature, pressure, and entropy, expected suction state module 216 may determine any expected thermodynamic property of the refrigerant at the suction side of compressor 48 (e.g., enthalpy, internal energy, specific volume, density, etc.) using the state equations stored in state equation module 214.

Still referring to FIG. 4, memory 208 is shown to include an actual suction state module 218. Actual suction state module 218 may be configured to determine or calculate actual thermodynamic properties of the refrigerant at the suction side of compressor 48. In some embodiments, actual suction state module 218 calculates an actual entropy $s_{suc,act}$ and an actual enthalpy $h_{suc,act}$ of the refrigerant at the suction side of compressor 48 using the measured temperature $T_{suc,act}$ and/or the measured pressure $P_{suc,act}$ of the refrigerant at the suction side of compressor 48. In some embodiments, actual suction state module 218 assumes that the refrigerant is a saturated vapor (i.e., quality=1) at the suction side of compressor 48. For example, actual suction state module 218 may calculate an actual suction entropy $s_{suc,act}$ and an actual suction enthalpy $h_{suc,act}$ using the equations:

$$s_{suc,act}=s_{sat}(P_{suc,act})$$

$$h_{suc,act}=h_{sat}(P_{suc,act})$$

where $s_{sat}$( ) and $h_{sat}$( ) are functions that return the saturation entropy and saturation enthalpy, respectively, of the refrigerant at a particular pressure provided as an input. In other embodiments, actual suction state module 218 may calculate the actual suction entropy $s_{suc,act}$ and an actual suction enthalpy $h_{suc,act}$ as a function of the measured temperature $T_{suc,act}$.

Still referring to FIG. 4, memory 208 is shown to include an isentropic discharge state module 220. Isentropic discharge state module 220 may be configured to determine or calculate thermodynamic properties of the refrigerant at the discharge of compressor 48 assuming that the compression performed by compressor 48 is an ideal isentropic compression (i.e., a compression that does not increase the entropy of the refrigerant). The isentropic properties calculated by isentropic discharge state module 220 may be based on the expected state of the refrigerant at the suction side of compressor 48 (i.e., characterized by the properties calculated by expected suction state module 216) or the actual state of the refrigerant at the suction side of compressor 48 (i.e., characterized by the properties calculated by actual suction state module 218).

Using the expected state of the refrigerant at the suction side of compressor 48 as the base state, isentropic discharge state module 220 may calculate an expected isentropic discharge temperature $T_{dis,s}$, an expected isentropic discharge enthalpy $h_{dis,s}$, and/or an expected isentropic discharge entropy $s_{dis,s}$ of the refrigerant at the discharge side of compressor 48. Since the compression is assumed to be isentropic, the expected isentropic discharge entropy $s_{dis,s}$ is the same as the expected suction entropy $s_{suc,exp}$:

$$s_{dis,s}=s_{suc,exp}$$

Isentropic discharge state module 220 may calculate the expected isentropic discharge temperature $T_{dis,s}$ and the expected isentropic discharge enthalpy $h_{dis,s}$ using the equations:

$$T_{dis,s}=T(P_{dis,act},s_{dis,s})$$

$$h_{dis,s}=h(P_{dis,act}T_{dis,s})$$

where T( ) and h( ) are functions that return the temperature and enthalpy of the refrigerant as a function of two unique thermodynamic properties (e.g., pressure and entropy, pressure and temperature, temperature and entropy, etc.) and $P_{dis,act}$ is the actual discharge pressure measured at the discharge side of compressor 48.

Using the actual state of the refrigerant at the suction side of compressor 48 as the base state, isentropic discharge state module 220 may calculate an isentropic discharge temperature $T_{dis,s}$, an isentropic discharge enthalpy $h_{dis,s}$, and an isentropic discharge entropy $s_{dis,s}$ of the refrigerant at the discharge side of compressor 48. Since the compression is assumed to be isentropic, the isentropic discharge entropy $s_{dis,s}$ is the same as the actual suction entropy $s_{suc,act}$:

$$s_{dis,s}=s_{suc,act}$$

Isentropic discharge state module 220 may calculate the isentropic discharge temperature $T_{dis,s}$ and the isentropic discharge enthalpy $h_{dis,s}$ using the equations:

$$T_{dis,s}=T(P_{dis,act},s_{dis,s})$$

$$h_{dis,s}=h(P_{dis,act},T_{dis,s})$$

where T( ), h( ) and $P_{dis,act}$ are the same as previously described.

Still referring to FIG. 4, memory 208 is shown to include an actual discharge state module 222. Actual discharge state module 222 may be configured to determine or calculate actual thermodynamic properties of the refrigerant at the discharge of compressor 48. In some embodiments, actual discharge state module 222 calculates an actual entropy $s_{dis,act}$ and an actual enthalpy $h_{dis,act}$ of the refrigerant at the discharge side of compressor 48 using the measured temperature $T_{dis,act}$ and/or the measured pressure $P_{dis,act}$ of the refrigerant at the discharge side of compressor 48. For example, actual discharge state module 222 may calculate an actual discharge enthalpy $h_{dis,act}$ using the equation:

$$h_{dis,act}=h(P_{dis,act},T_{dis,act})$$

where $P_{dis,act}$ and $T_{dis,act}$ are the actual pressure and the actual temperature measured at the discharge of compressor 48 and h( ) is a function that returns the enthalpy of the refrigerant as a function of pressure and temperature.

Still referring to FIG. 4, memory 208 is shown to include an expected discharge state module 224. Expected discharge state module 224 may be configured to determine or calculate expected thermodynamic properties of the refrigerant at the discharge of compressor 48. In some embodiments, expected discharge state module 224 calculates an expected discharge enthalpy $h_{dis,exp}$ and an expected discharge temperature $T_{dis,exp}$ of the refrigerant at the discharge of compressor 48 using the expected suction enthalpy $h_{suc,exp}$, the expected isentropic discharge enthalpy $h_{dis,s}$, and the isentropic efficiency $\eta_s$ of compressor 48. Expected discharge state module 224 may calculate the isentropic efficiency $\eta_s$ of compressor 48 using the equation:

$$\eta_s = \frac{h_{dis,s} - h_{suc,act}}{h_{dis,act} - h_{suc,act}}$$

where $\eta_s$ is the isentropic efficiency of compressor 48 for the actual compression process.

Expected discharge state module 224 may calculate the expected discharge enthalpy $h_{dis,exp}$ and the expected discharge temperature $T_{dis,exp}$ using the assumption that the isentropic efficiency $\eta_s$ for the actual and expected compression processes are the same. For example, expected discharge state module 224 may calculate the expected discharge enthalpy $h_{dis,exp}$ and the expected discharge temperature $T_{dis,exp}$ using the equations:

$$h_{dis,exp} = \frac{h_{dis,s} - h_{suc,exp}}{\eta_s} + h_{suc,exp}$$

where T( ) is a function that returns the temperature of the refrigerant as a function of pressure and enthalpy. The expected discharge temperature $T_{dis,exp}$ may be compared with the actual discharge temperature $T_{dis,act}$ to detect and diagnose faults in the refrigeration circuit, as described with reference to fault detector modules 228-232.

Still referring to FIG. 4, memory 208 is shown to include a discharge superheat module 226. Discharge superheat module 226 may be configured to calculate an amount of superheat of the refrigerant at the discharge of compressor 48. The amount of superheat may be defined as the difference between the actual temperature $T_{dis,act}$ of the refrigerant at the discharge of compressor 48 and the saturation temperature $T_{dis,sat}$ of the refrigerant at the discharge pressure $P_{dis,act}$. Discharge superheat module 226 may calculate the saturation temperature $T_{dis,sat}$ using the equation:

$$T_{dis,sat}=T_{sat}(P_{dis,act})$$

where $T_{sat}$( ) is a function that returns the saturation temperature of the refrigerant as a function of pressure.

Once the saturation temperature $T_{dis,sat}$ is determined, discharge superheat module 226 may calculate the amount of superheat $Supht_{dis,act}$ at the discharge of compressor 48 using the equation:

$$Supht_{dis,act}=T_{dis,act}-T_{dis,sat}$$

The amount of superheat $Supht_{dis,act}$ may be compared with a threshold value (e.g., an expected amount of superheat $Supht_{dis,exp}$ based on expected discharge conditions) to detect and diagnose faults in the refrigeration circuit.

Still referring to FIG. 4, memory 208 is shown to include an evaporator fouling fault detector 228. Evaporator fouling fault detector 228 may be configured to detect and diagnose an evaporator fouling fault in the refrigeration circuit using the parameters and values generated by modules 210-226. Evaporator fouling may occur when the thermal resistance of evaporator 46 increases (e.g., due to corrosion, chemical damage, accumulation of precipitants or particulate matter in the evaporator, etc.), thereby reducing the evaporator's heat transfer coefficient and inhibiting heat transfer to the refrigerant flowing through evaporator 46.

For evaporator 46 to continue transferring the required amount of heat to the refrigerant, the evaporator temperature $T_{suc,act}$ and pressure $P_{suc,act}$ may decrease from their expected values. Such a reduction of evaporating pressure may increase the pressure lift required by compressor 48, resulting in additional power consumption and reducing the energy efficiency of the refrigeration circuit. One of the difficulties in detecting evaporator fouling is that the temperature and corresponding pressure drop at evaporator 46 may be relatively small and may not be readily detected due to the intrinsic measurement errors of temperature and pressure sensors positioned to measure evaporator conditions. However, the effect of evaporator fouling on the compressor discharge temperature may be significantly more noticeable.

Advantageously, evaporator fouling fault detector 228 may detect an evaporator fouling fault by comparing the actual measured temperature $T_{dis,act}$ of the refrigerant at the discharge of compressor 48 with the expected temperature $T_{dis,exp}$ of the refrigerant at the discharge of compressor 48. If the measured discharge temperature $T_{dis,act}$ exceeds the expected discharge temperature $T_{dis,exp}$ by a threshold value $thresh_1$, evaporator fouling fault detector 228 may determine that an evaporator fouling fault has been detected. I.e.:

$$\text{[FOULING FAULT] if } T_{dis,act}-T_{dis,exp}>thresh_1$$

In other embodiments, evaporator fouling fault detector 228 may detect an evaporator fouling fault by comparing the actual amount of superheat $Supht_{dis,act}$ of the refrigerant at the discharge of compressor 48 outlet with the expected amount of superheat $Supht_{dis,exp}$ at the discharge of compressor 48 based on the expected discharge state. If the actual amount of superheat $Supht_{dis,act}$ exceeds the expected amount of superheat $Supht_{dis,exp}$ by a threshold value $thresh_2$, evaporator fouling fault detector 228 may determine that an evaporator fouling fault has been detected. I.e.:

$$\text{[FOULING FAULT] if } Supht_{dis,act}-Supht_{dis,exp}>thresh_2$$

Still referring to FIG. 4, memory 208 is shown to include a compressor efficiency fault detector 230. Compressor efficiency fault detector 230 may be configured to detect and diagnose a compressor efficiency fault in the refrigeration circuit. Compressor efficiency fault detector 230 may detect the compressor efficiency fault by comparing a calculated compressor efficiency $\eta$ with a threshold value $thresh_3$. In some embodiments, the calculated compressor efficiency $\eta$ is the isentropic efficiency $\eta_s$ defined by the following equation:

$$\eta_s = \frac{h_{dis,s} - h_{suc,act}}{h_{dis,act} - h_{suc,act}}$$

Compressor efficiency fault detector 230 may calculate isentropic efficiency $\eta_s$ using the values of $h_{dis,s}$, $h_{suc,act}$, and $h_{dis,act}$ provided by isentropic discharge state module 220, actual suction state module 218, and actual discharge state module 222, respectively. Threshold value $thresh_3$ may be a previously-determined compressor efficiency, a manufacturer-provided compressor efficiency, or another benchmark against which $\eta_s$ can be compared.

Compressor efficiency fault detector 230 may compare the isentropic compressor efficiency $\eta_s$ with the threshold value $thresh_3$. If the isentropic compressor efficiency $\eta_s$ is less than the threshold value $thresh_3$ (or less than the threshold value $thresh_3$ by more than a predetermined amount), compressor efficiency fault detector 230 may determine that a compressor efficiency fault has been detected. I.e.:

$$\text{[EFFICIENCY FAULT] if } \eta_s<thresh_3$$

Still referring to FIG. 4, memory 208 is shown to include a liquid carryover fault detector 232. Liquid carryover fault detector 232 may be configured to detect a liquid carryover fault in the refrigeration circuit. A liquid carryover fault may occur when evaporator 46 is not able to evaporate the entire refrigerant flow, resulting in the carryover of some liquid refrigerant to compressor 48. In compressor 48, the liquid refrigerant may be converted to vapor while the compression process is occurring. When the refrigerant is a mixture of liquid and vapor, the temperature and pressure remain fixed at the saturation values. This fact makes detecting liquid at the suction of compressor 48 impossible using only temperature and/or pressure sensors positioned along suction line 72. However, liquid carryover fault detector 232 may use the thermodynamic state of the refrigerant at the discharge of compressor 48 to detect the liquid carryover fault.

Advantageously, liquid carryover fault detector 232 may detect the liquid carryover fault by comparing the measured temperature $T_{dis,act}$ of the refrigerant at the discharge of compressor 48 with a calculated temperature $T_{dis,s}$ of the refrigerant at the discharge of compressor 48. In some embodiments, the calculated temperature $T_{dis,s}$ of the refrigerant is the temperature resulting from an isentropic compression of a saturated vapor refrigerant from the actual suction pressure $P_{suc,act}$ to the actual discharge pressure $P_{dis,act}$. For example, liquid carryover fault detector 232 may compute the calculated discharge temperature $T_{dis,s}$ using the following equations:

$$T_{suc,exp}=T_{sat}(P_{suc,act})$$

$$S_{suc,exp}=s_{sat}(T_{suc,exp})$$

$$s_{dis,exp}=s_{suc,exp}$$

$$T_{dis,s}=T(P_{dis,act},s_{dis,exp})$$

where $s_{suc,exp}$ is the expected entropy at the suction side of compressor 48 assuming that the refrigerant has evaporated to a saturated vapor in evaporator 46, $s_{dis,exp}$ is the expected entropy at the discharge side of compressor 48 resulting from an isentropic compression of the saturated vapor refrigerant, and $T_{dis,s}$ is the expected temperature at the discharge of compressor 48 at the measured discharge pressure $P_{dis,act}$, based on the assumption that the refrigerant is a saturated vapor at the suction of compressor 48.

Liquid carryover fault detector 232 may compare the measured temperature $T_{dis,act}$ of the refrigerant at the discharge of compressor 48 with the calculated temperature $T_{dis,s}$. If the measured discharge temperature $T_{dis,act}$ is less than the calculated discharge temperature $T_{dis,s}$, liquid carryover fault detector 232 may determine that the liquid carryover fault has been detected. I.e.:

$$\text{[CARRYOVER FAULT] if } T_{dis,act}<T_{dis,s}$$

A value of $T_{dis,act}<T_{dis,s}$ indicates that the refrigerant was not fully evaporated prior to compression and that the actual entropy of the refrigerant at the suction of compressor 48 is less than the expected entropy $s_{suc,exp}$.

In other embodiments, liquid carryover fault detector 232 may detect the liquid carryover fault by comparing an amount of superheat $Supht_{dis,act}$ of the refrigerant at the compressor outlet with a threshold value. The threshold value may be, for example, an expected amount of superheat $Supht_{dis,s}$ resulting from an isentropic compression from the suction pressure $P_{suc,act}$ to the discharge pressure $P_{dis,act}$ when the refrigerant enters compressor 48 as a saturated vapor. If the actual amount of superheat $Supht_{dis,act}$ is less than the threshold value $Supht_{dis,s}$, liquid carryover fault detector 232 may determine that the liquid carryover fault has been detected. I.e.:

$$\text{[CARRYOVER FAULT] if } Supht_{dis,act}<Supht_{dis,s}$$

A value of $Supht_{dis,act}<Supht_{dis,s}$ indicates that the refrigerant was not fully evaporated prior to compression and that the actual entropy of the refrigerant at the suction of compressor 48 is less than the expected entropy $s_{suc,exp}$.

In some embodiments, FDD system 200 generates notifications (e.g., alerts, alarms, reports, messages, etc.) in response to detecting the evaporator fouling fault, the compressor efficiency fault, and/or the liquid carryover fault. FDD system 200 may provide the generated notifications to upstream controller 242, client device 244, a remote computer system, a graphical user interface, a data storage device, or any other system or device configured to present the notifications to a user or store the notifications for subsequent reporting and/or analysis.

Referring now to FIGS. 5-8, a set of thermodynamic state diagrams 300, 320, 340, and 360 illustrating the thermodynamic principles used by FDD system 200 to detect and diagnose faults in the refrigeration circuit are shown, according to an exemplary embodiment.

Figure 5:
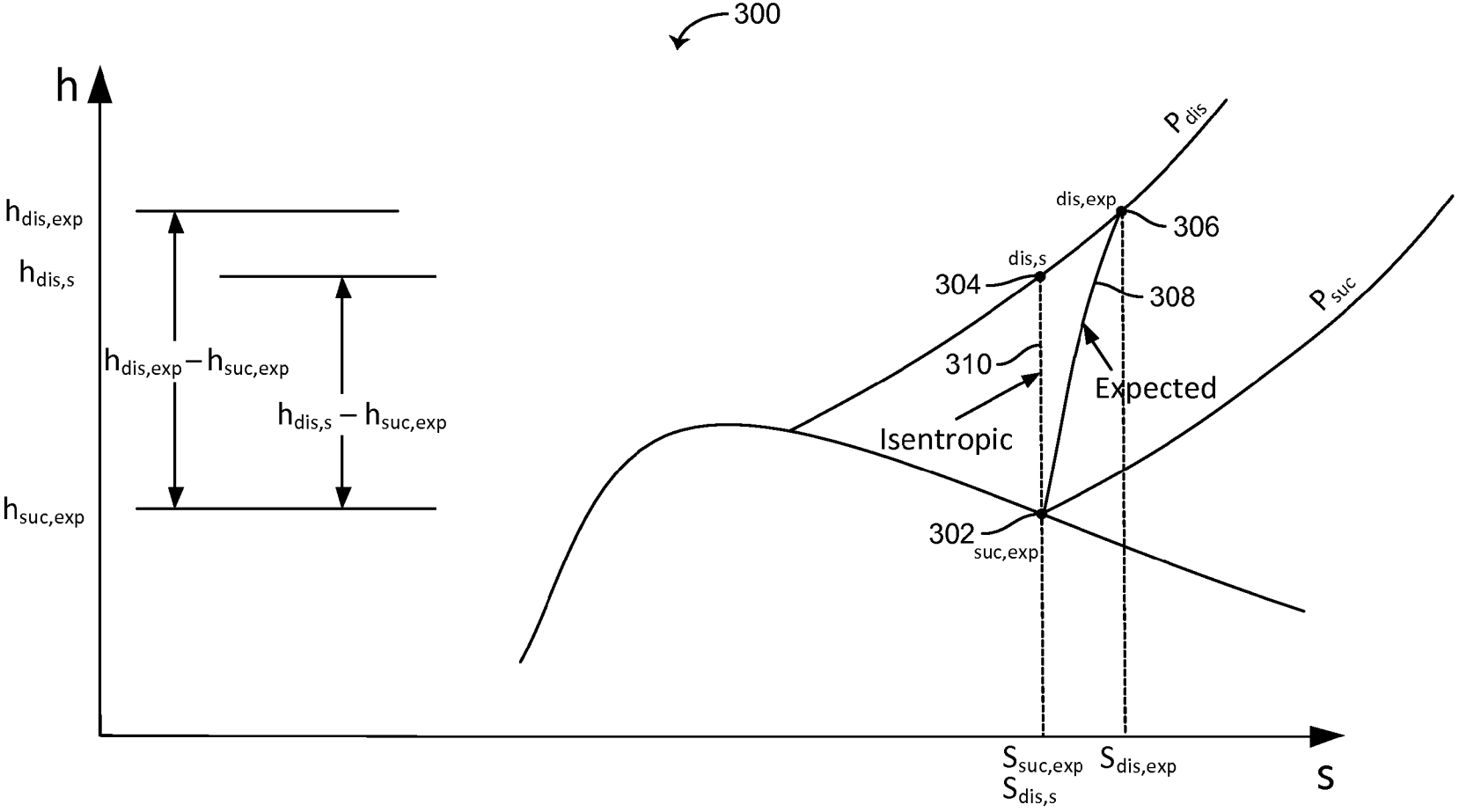
FIG. 5 is an enthalpy-entropy (H-S) diagram illustrating an isentropic compression process and an expected compression process that may be performed by the refrigeration circuits of FIGS. 2-3, according to an exemplary embodiment.
Figure 6:
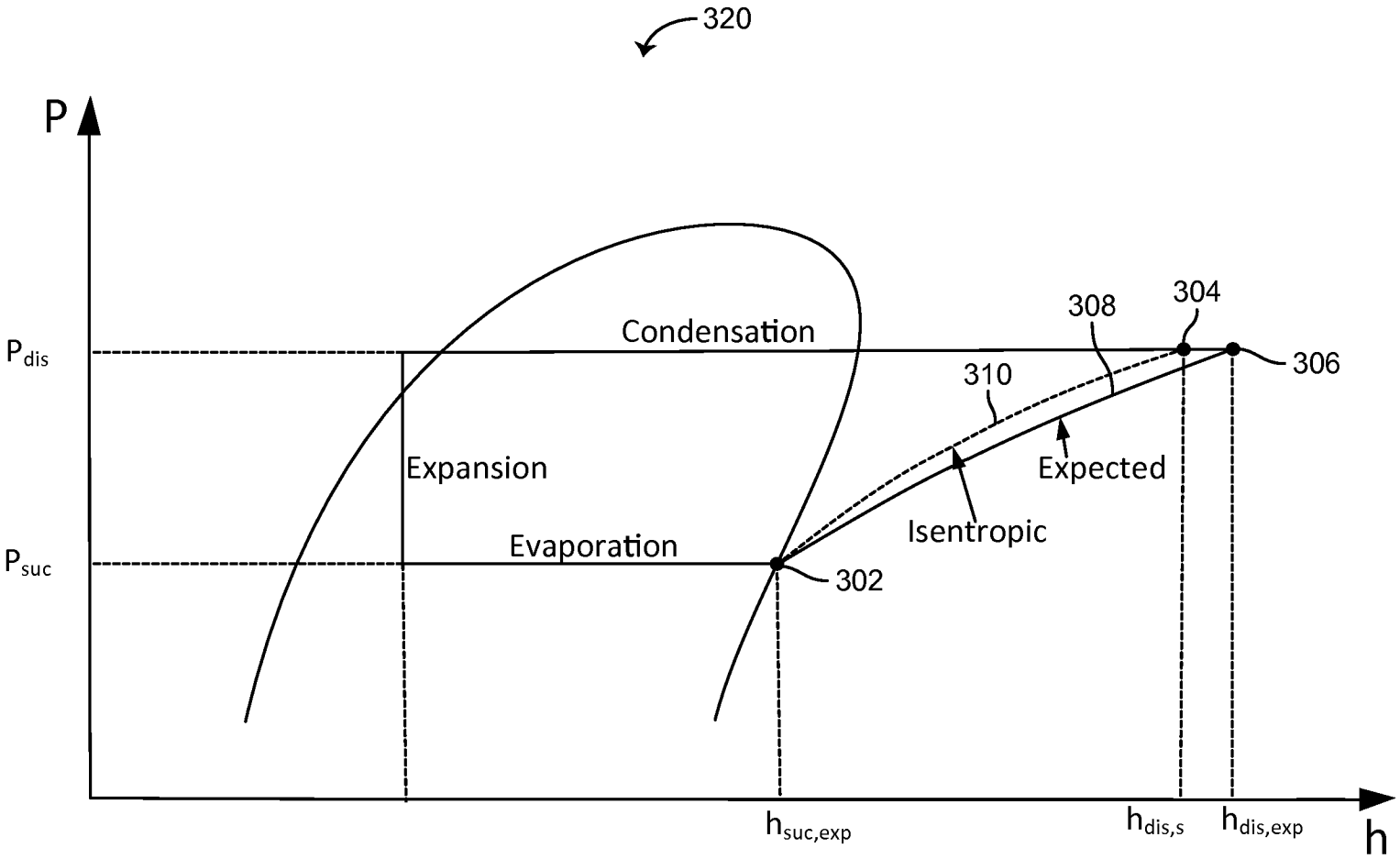
FIG. 6 is a pressure-enthalpy (P-H) diagram illustrating pressure and enthalpy relationships of the isentropic and expected compression processes of FIG. 5, according to an exemplary embodiment.

Referring specifically to FIGS. 5-6, an enthalpy-entropy (H-S) diagram 300 and pressure-enthalpy (P-H) diagram 320 illustrating the isentropic and expected compression processes performed by compressor 48 is shown. Compressor 48 compresses the refrigerant from an expected suction state 302 to an expected discharge state 306. At expected suction state 302, the pressure of the refrigerant is measured (e.g., by pressure sensor 78) to be $P_{suc}$. In state 302, the refrigerant is expected to be a saturated vapor. Expected suction state module 216 may calculate the expected enthalpy $h_{suc,exp}$ and the expected entropy $s_{suc,exp}$ as a function of the measured suction pressure $P_{suc}$. The discharge pressure $P_{dis}$ of the refrigerant may also be measured (e.g., by pressure sensor 82).

In the expected compression process 308 performed by compressor 48, the refrigerant is compressed from expected suction state 302 to expected discharge state 306. In expected discharge state 306, the refrigerant has an expected discharge enthalpy $h_{dis,exp}$ and an expected discharge entropy $s_{dis,exp}$. For a compression process with negligible heat transfer to the surroundings and no appreciable kinetic or potential energy change, the work per unit mass w (e.g., kJ/kg) input by compressor 48 may be calculated using the following equation:

$$w=h_{dis,exp}-h_{suc,exp}$$

Work w has a theoretical minimum defined by the minimum possible enthalpy of the refrigerant at the discharge pressure $P_{dis}$. According to the second law of thermodynamics, the minimum theoretical work w corresponds to the isentropic compression process 310 from expected suction state 302 to isentropic discharge state 304. The minimum possible value for work per unit mass w is defined by the equation:

$$w_{min}=h_{dis,s}-h_{suc,exp}$$

where $h_{dis,s}$ is the minimum possible discharge enthalpy corresponding to the isentropic discharge state 304.

Isentropic discharge state 304 is constrained by the equation:

$$\sigma_s=s_{dis,s}-s_{suc,exp}\geq 0$$

where $\sigma_s$ is the entropy production in compressor 48, $s_{dis,s}$ is the entropy of the refrigerant in isentropic discharge state 304, and $s_{suc,exp}$ is the entropy of the refrigerant in expected suction state 302. To abide with the second law of thermodynamics, entropy production $\sigma_s$ must be non-negative. For the isentropic compression process 310, entropy production $\sigma_s$ is zero.

Figure 7:
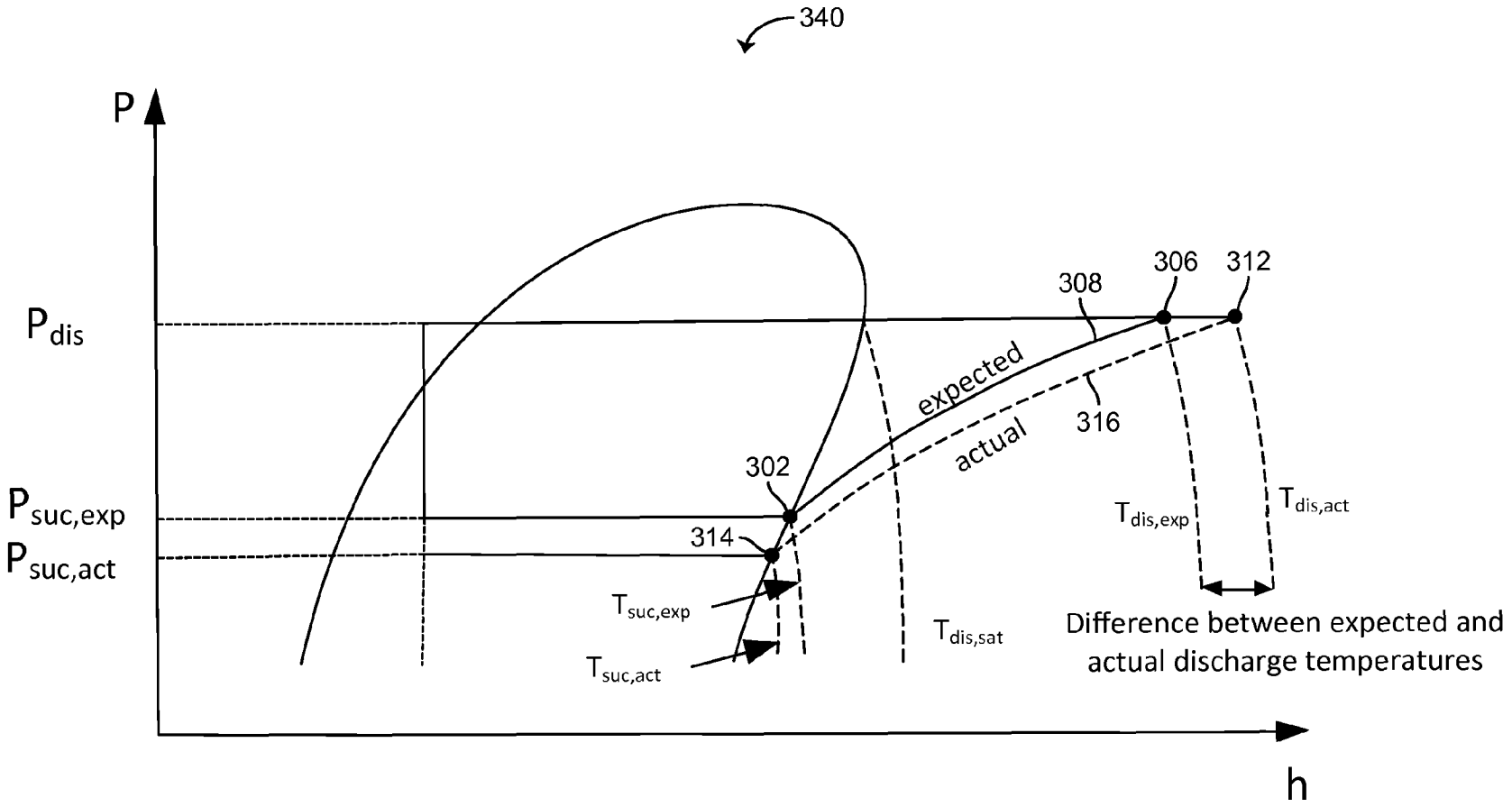
FIG. 7 is a pressure-enthalpy (P-H) diagram illustrating a thermodynamic principle used by the FDD system of FIG. 4 to detect an evaporator fouling fault, according to an exemplary embodiment.

Referring specifically to FIG. 7, a pressure-enthalpy (P-H) diagram 340 illustrating the thermodynamic principle used by evaporator fouling fault detector 228 to detect the evaporator fouling fault is shown, according to an exemplary embodiment. When evaporator fouling occurs, evaporator temperature and pressure may decrease from their expected values to compensate for less efficient heat transfer in evaporator 46. For example, when an evaporator fouling fault is present, the refrigerant may be provided at the suction side of compressor 48 in actual suction state 314. In actual suction state 314, the refrigerant has an actual suction temperature $T_{suc,act}$ less than $T_{suc,exp}$ and an actual suction pressure $P_{suc,act}$ less than $P_{suc,exp}$.

When an evaporator fouling fault occurs, compressor 48 compresses the refrigerant from actual suction state 314 to actual discharge state 312 along actual compression line 316. In actual discharge state 312, the refrigerant has an actual discharge temperature $T_{dis,act}$ greater than $T_{dis,exp}$. Evaporator fouling fault detector 228 uses the difference between $T_{dis,act}$ and $T_{dis,exp}$ to detect the evaporator fouling fault, as described with reference to FIG. 4. For example, evaporator fouling fault detector 228 may determine that an evaporator fouling fault is present if $T_{dis,act}$ exceeds $T_{dis,exp}$ by an amount greater than or equal to a threshold value.

Figure 8:
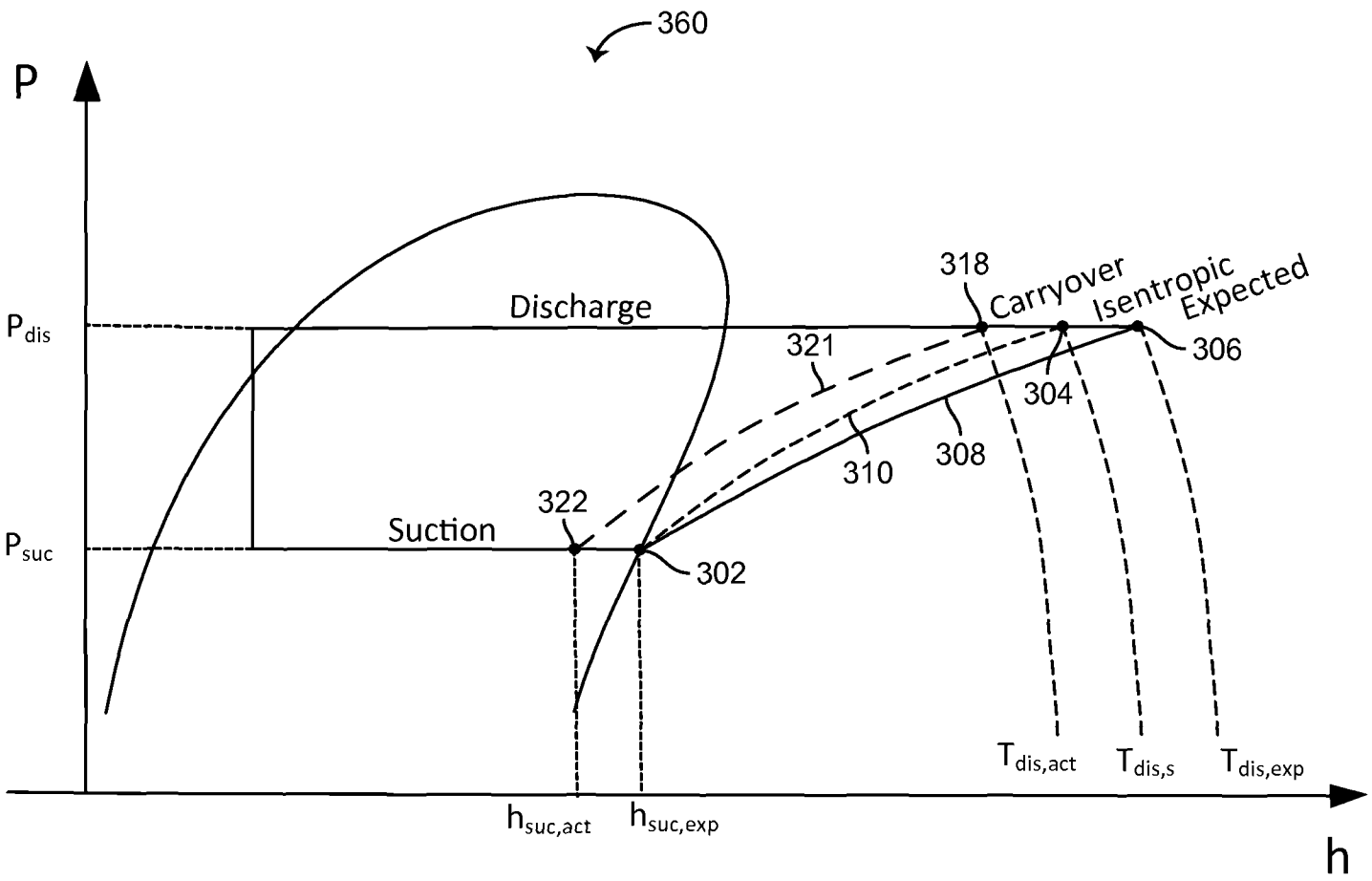
FIG. 8 is a pressure-enthalpy (P-H) diagram illustrating a thermodynamic principle used by the FDD system of FIG. 4 to detect a liquid carryover fault, according to an exemplary embodiment.

Referring specifically to FIG. 8, a pressure-enthalpy (P-H) diagram 360 illustrating the thermodynamic principle used by liquid carryover fault detector 232 to detect the liquid carryover fault is shown, according to an exemplary embodiment. When a liquid carryover fault occurs, the refrigerant does not completely evaporate in evaporator 46 and is provided to compressor 48 as a liquid-vapor mixture (i.e., quality <1). For example, when the liquid carryover fault is present, the refrigerant may be provided to compressor 48 in actual suction state 322. In actual suction state 322, the refrigerant has an actual suction enthalpy $h_{suc,act}$, which is less than the expected suction enthalpy $h_{suc,exp}$ in state 302 (i.e., the suction enthalpy that would be expected if the refrigerant were a saturated vapor at the suction of compressor 48).

When a liquid carryover fault occurs, compressor 48 compresses the refrigerant to actual discharge state 318 along actual compression line 321. In actual discharge state 318, the refrigerant has an actual discharge temperature $T_{dis,act}$ less than $T_{dis,s}$. Values of $T_{dis,act}<T_{dis,s}$ are not possible unless the refrigerant enters compressor 48 as a liquid or liquid-vapor mixture (i.e., in actual suction state 322), which defines the liquid carryover fault. Liquid carryover fault detector 232 may use the difference between $T_{dis,act}$ and $T_{dis,s}$ to detect the liquid carryover fault, as described with reference to FIG. 4. In other embodiments, liquid carryover fault detector 232 uses the difference between $T_{dis,act}$ and $T_{dis,exp}$ to detect the liquid carryover fault. For example, liquid carryover fault detector 232 may determine that a liquid carryover fault is present if $T_{dis,act}$ is less than $T_{dis,s}$ or less than $T_{dis,exp}$ by an amount exceeding a threshold value.

Figure 9:
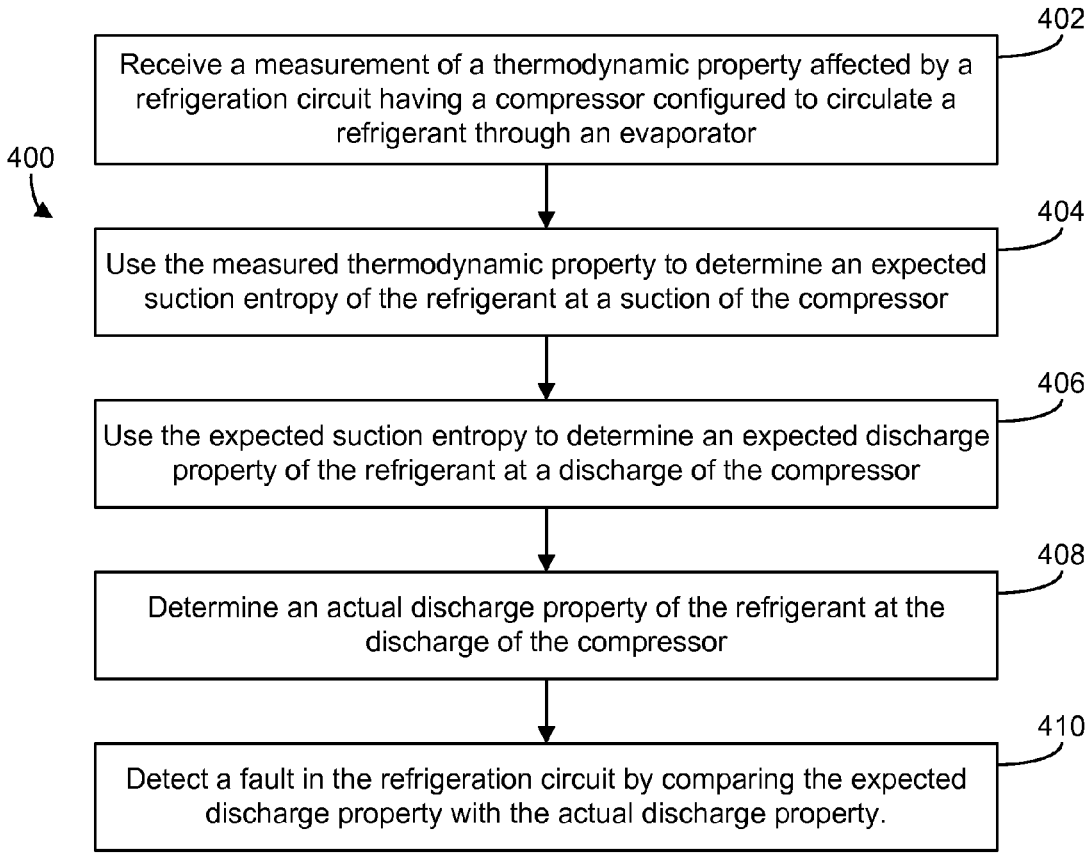
FIG. 9 is a flowchart of a process for detecting and diagnosing faults in a refrigeration circuit using thermodynamic properties, according to an exemplary embodiment.

Referring now to FIG. 9, a flowchart of a process 400 for detecting and diagnosing faults in a refrigeration circuit using thermodynamic properties is shown, according to an exemplary embodiment. In some embodiments, process 400 is performed by FDD system 200 using various modules of memory 208, as described with reference to FIG. 4. Process 400 may be used to detect an evaporator fouling fault, a liquid carryover fault, or a compressor efficiency fault.

Process 400 is shown to include receiving a measurement of a thermodynamic property affected by a refrigeration circuit (step 402). The refrigeration circuit (e.g., refrigeration circuit 42 or 84) may have a an evaporator, a condenser, an expansion valve, and a compressor configured to circulate a refrigerant between the evaporator and the condenser, as described with reference to FIGS. 2-3. The measured thermodynamic property may be received at communications interface 202 of FDD system 200. In some embodiments, step 402 is performed by sensor input module 212.

The measured thermodynamic property may be a thermodynamic property (e.g., temperature, pressure, quality, etc.) of the refrigerant circulated within the refrigeration circuit or a thermodynamic property of a secondary fluid chilled from which the refrigerant absorbs heat in the evaporator. For example, in some embodiments, the thermodynamic property received in step 402 is the temperature of the refrigerant measured by a temperature sensor located along a suction line connecting the evaporator and the compressor. In other embodiments, the thermodynamic property received in step 402 is a temperature of the secondary fluid measured by a temperature sensor located downstream of the evaporator in the secondary fluid circuit. The measured thermodynamic property may be stored in memory 208 (e.g., in parameter storage module 210) for use in subsequent steps of process 400.

Still referring to FIG. 9, process 400 is shown to include using the measured thermodynamic property to determine an expected suction entropy of the refrigerant at a suction of the compressor (step 404). In some embodiments, step 404 is performed by expected suction state module 216. Step 404 may include using the measured temperature of the secondary fluid and an expected approach of the evaporator to determine an expected suction temperature of the refrigerant at the suction of the compressor. For example, the expected suction temperature may be calculated in step 404 using the equation:

$$T_{suc,exp}=T_{cf}-\mathrm{EA}_{exp}$$

where $\mathrm{EA}_{exp}$ is the expected approach for the evaporator and $T_{cf}$ is the measured temperature of the secondary fluid (e.g., chilled air, water, or another fluid chilled by the evaporator) downstream of the evaporator. The expected suction temperature of the refrigerant may then be used to calculate the expected suction entropy. In some embodiments, the expected suction entropy calculated in step 404 is the entropy corresponding to a saturated vapor state of the refrigerant at the expected suction temperature. For example, the expected entropy $s_{suc,exp}$ may be calculated using the equation:

$$s_{suc,exp}=s_{sat}(T_{suc,exp})$$

where $s_{sat}(\ )$ is a function that returns the saturation entropy of the refrigerant as a function of temperature.

In other embodiments, step 404 includes using an actual (e.g., measured) thermodynamic property of the refrigerant at the suction of the compressor to determine the expected suction entropy. For example, step 404 may calculate the expected suction entropy $s_{suc,exp}$ using the equations:

$$T_{suc,exp}=T_{sat}(P_{suc,act})$$

$$s_{suc,exp}=s_{sat}(T_{suc,exp})$$

where $P_{suc,act}$ is the actual suction pressure of the refrigerant at the suction of the compressor, $T_{sat}(\ )$ is a function that returns the saturation temperature of the refrigerant as a function of pressure, and $s_{sat}(\ )$ is a function that returns the saturation entropy of the refrigerant as a function of temperature. The expected suction entropy calculated in step 404 may correspond to the entropy of a saturated vapor refrigerant at the measured suction pressure.

In some embodiments, step 404 includes calculating other expected properties of the refrigerant at the suction of the compressor. For example, step 404 may include determining any expected thermodynamic property of the refrigerant at the suction side of compressor 48 (e.g., enthalpy, internal energy, specific volume, density, pressure, temperature, entropy, quality, etc.) using the state equations stored in state equation module 214.

Still referring to FIG. 9, process 400 is shown to include using the expected suction entropy to determine an expected discharge property of the refrigerant at a discharge of the compressor (step 406). In various embodiments, the expected discharge property may be an isentropic discharge property or an estimated discharge property based on the isentropic discharge property and an isentropic efficiency of the compressor. The expected discharge property determined in step 406 may be based on an expected suction property of the refrigerant at the suction of the compressor (e.g., as determined by expected suction state module 216) or an actual suction property of the refrigerant at the suction of the compressor (e.g., as determined by actual suction state module 218).

For embodiments in which the expected suction state determined by expected suction state module 216 is used as the base state, step 406 may include calculating an expected isentropic discharge temperature $T_{dis,s}$, an expected isentropic discharge enthalpy $h_{dis,s}$, and/or an expected isentropic discharge entropy $s_{dis,s}$ of the refrigerant at the discharge of the compressor. The expected isentropic discharge entropy $s_{dis,s}$ is the same as the expected suction entropy $s_{suc,exp}$ for an isentropic compression process:

$$s_{dis,s}=s_{suc,exp}$$

The expected isentropic discharge temperature $T_{dis,s}$ and the expected isentropic discharge enthalpy $h_{dis,s}$ may be calculated using the equations:

$$T_{dis,s}=T(P_{dis,act},s_{dis,s})$$

$$h_{dis,s}=h(P_{dis,act},T_{dis,s})$$

where T( ) and h( ) are functions that return the temperature and enthalpy of the refrigerant as a function of two unique thermodynamic properties (e.g., pressure and entropy, pressure and temperature, temperature and entropy, etc.) and $P_{dis,act}$ is the actual discharge pressure measured at the discharge side of the compressor.

For embodiments in which the actual suction state determined by actual suction state module 218 is used as the base state, step 406 may include calculating an actual isentropic discharge temperature $T_{dis,s}$, an actual isentropic discharge enthalpy $h_{dis,s}$, and an actual isentropic discharge entropy $s_{dis,s}$ of the refrigerant at the discharge of the compressor. The actual isentropic discharge entropy $s_{dis,s}$ is the same as the actual suction entropy $s_{suc,act}$ for an isentropic compression process:

$$s_{dis,s}=s_{suc,act}$$

The actual isentropic discharge temperature $T_{dis,s}$ and the actual isentropic discharge enthalpy $h_{dis,s}$ may be calculated using the equations:

$$T_{dis,s}=T(P_{dis,act},s_{dis,s})$$

$$h_{dis,s}=h(P_{dis,act},T_{dis,s})$$

where T( ) h( ) and $P_{dis,act}$ are the same as previously described.

In some embodiments, step 406 includes identifying an isentropic efficiency of the compressor. In some embodiments, the isentropic efficiency is provided by a compressor manufacturer and may be retrieved from memory in step 406. In other embodiments, the isentropic efficiency is calculated based on measured values. For example, the isentropic efficiency $\eta_s$ of the compressor may be calculated using the equation:

$$\eta_s = \frac{h_{dis,s} - h_{suc,act}}{h_{dis,act} - h_{suc,act}}$$

where $h_{dis,s}$ is the actual isentropic discharge enthalpy, $h_{suc,act}$ is the actual suction enthalpy, and $h_{dis,act}$ is the actual discharge enthalpy.

Step 406 may include using the expected suction enthalpy, the isentropic discharge enthalpy, and the isentropic efficiency to calculate an expected discharge enthalpy of the refrigerant at the discharge of the compressor. For example, step 406 may include calculating the expected discharge enthalpy $h_{dis,exp}$ using the equation:

$$h_{dis,exp} = \frac{h_{dis,s} - h_{suc,exp}}{\eta_s} + h_{suc,exp}$$

Step 406 may include using the expected discharge enthalpy and the measured discharge pressure to calculate an expected discharge temperature of the refrigerant at the discharge of the compressor. For example, step 406 may include calculating the expected discharge temperature $T_{dis,exp}$ using the following equation:

$$T_{dis,exp}=T(P_{dis,act},h_{dis,exp})$$

In some embodiments, the expected discharge property determined in step 406 is an expected discharge temperature. In other embodiments, the expected discharge property is an expected amount of superheat corresponding to a difference between the expected discharge temperature and a saturation temperature of the refrigerant at a measured discharge pressure. In some embodiments, the expected discharge property is an isentropic discharge property resulting from an ideal isentropic compression of the refrigerant from a saturated vapor at the suction of the compressor to superheated vapor at the discharge of the compressor.

Still referring to FIG. 9, process 400 is shown to include determining an actual discharge property of the refrigerant at the discharge of the compressor (step 408). Step 408 may be performed by actual discharge state module 222, as described with reference to FIG. 4. In some embodiments, the actual discharge property is an actual temperature or an actual pressure measured by a sensor located along a discharge line connecting the discharge of the compressor with the condenser. Step 408 may include calculating an actual entropy $s_{dis,act}$ and/or an actual enthalpy $h_{dis,act}$ of the refrigerant at the discharge of the compressor using the measured temperature $T_{dis,act}$ and/or the measured pressure $P_{dis,act}$ of the refrigerant at the discharge of the compressor. For example, step 408 may include calculating an actual discharge enthalpy $h_{dis,act}$ using the equation:

$$h_{dis,act}=h(P_{dis,act},T_{dis,act})$$

where $P_{dis,act}$ and $T_{dis,act}$ are the actual pressure and the actual temperature measured at the discharge of the compressor and h( ) is a function that returns the enthalpy of the refrigerant as a function of pressure and temperature.

Step 408 may include calculating an actual amount of superheat of the refrigerant at the discharge of the compressor. The actual amount of superheat may be defined as the difference between the actual temperature $T_{dis,act}$ of the refrigerant at the discharge of the compressor and the saturation temperature $T_{dis,sat}$ of the refrigerant at the discharge pressure $P_{dis,act}$. Step 408 may include calculating the saturation temperature $T_{dis,sat}$ using the equation:

$$T_{dis,sat}=T_{sat}(P_{dis,act})$$

where $T_{sat}(\ )$ is a function that returns the saturation temperature of the refrigerant as a function of pressure. Once the saturation temperature $T_{dis,sat}$ is determined, step 408 may include calculating the amount of superheat $Supht_{dis,act}$ at the discharge of the compressor using the equation:

$$Supht_{dis,act}=T_{dis,act}-T_{dis,sat}$$

Still referring to FIG. 9, process 400 is shown to include detecting a fault in the refrigeration circuit by comparing the expected discharge property with the actual discharge property (step 410). In some embodiments, step 410 includes detecting an evaporator fouling fault by comparing the actual measured temperature $T_{dis,act}$ of the refrigerant at the discharge of the compressor with the expected temperature $T_{dis,exp}$ of the refrigerant at the discharge of the compressor. If the measured discharge temperature $T_{dis,act}$ exceeds the expected discharge temperature $T_{dis,exp}$ by a threshold value $thresh_1$, step 410 may include determining that an evaporator fouling fault has been detected. I.e.:

$$\text{[FOULING FAULT] if } T_{dis,act}-T_{dis,exp}>thresh_1$$

In other embodiments, step 410 includes detecting the evaporator fouling fault by comparing the actual amount of superheat $Supht_{dis,act}$ of the refrigerant at the discharge of the compressor outlet with the expected amount of superheat $Supht_{dis,exp}$ at the discharge of the compressor based on the expected discharge state. If the actual amount of superheat $Supht_{dis,act}$ exceeds the expected amount of superheat $Supht_{dis,exp}$ by a threshold value $thresh_2$, step 410 may include determining that an evaporator fouling fault has been detected. I.e.:

$$\text{[FOULING FAULT] if } Supht_{dis,act}-Supht_{dis,exp}>thresh_2$$

In some embodiments, step 410 includes detecting a liquid carryover fault in the refrigeration circuit. The liquid carryover fault may be detected by comparing the measured temperature $T_{dis,act}$ of the refrigerant at the discharge of the compressor with a calculated temperature $T_{dis,s}$ of the refrigerant at the discharge of the compressor. In some embodiments, the calculated temperature $T_{dis,s}$ of the refrigerant is the temperature resulting from an isentropic compression of a saturated vapor refrigerant from the actual suction pressure $P_{suc,act}$ to the actual discharge pressure $P_{dis,act}$. For example, step 410 may include computing the calculated discharge temperature $T_{dis,s}$ using the following equations:

$$T_{suc,exp}=T_{sat}(P_{suc,act})$$

$$s_{suc,exp}=s_{sat}(T_{suc,exp})$$

$$s_{dis,s}=s_{suc,exp}$$

$$T_{dis,s}=T(P_{dis,act},s_{dis,s})$$

where $s_{suc,exp}$ is the expected entropy at the suction side of the compressor assuming that the refrigerant has evaporated to a saturated vapor in the evaporator, $s_{dis,s}$ is the expected entropy at the discharge side of the compressor resulting from an isentropic compression of the saturated vapor refrigerant, and $T_{dis,s}$ is the minimum expected temperature at the discharge of the compressor at the measured discharge pressure $P_{dis,act}$, based on the assumption that the refrigerant is a saturated vapor at the suction of the compressor and the compression is isentropic.

If the measured discharge temperature $T_{dis,act}$ is less than the calculated discharge temperature $T_{dis,s}$, step 410 may include determining that the liquid carryover fault has been detected. I.e.:

$$\text{[CARRYOVER FAULT] if } T_{dis,act}<T_{dis,s}$$

A value of $T_{dis,act}<T_{dis,s}$ indicates that the refrigerant was not fully evaporated prior to compression and that the actual entropy of the refrigerant at the suction of the compressor is less than the expected entropy $s_{suc,exp}$.

In other embodiments, step 410 includes detecting the liquid carryover fault by comparing an amount of superheat $Supht_{dis,act}$ of the refrigerant at the compressor outlet with a threshold value. The threshold value may be, for example, an expected amount of superheat $Supht_{dis,s}$ resulting from an isentropic compression from the suction pressure $P_{suc,act}$ to the discharge pressure $P_{dis,act}$ when the refrigerant enters the compressor as a saturated vapor.

If the actual amount of superheat $Supht_{dis,act}$ is less than the threshold value $Supht_{dis,s}$, step 410 may include determining that the liquid carryover fault has been detected. I.e.:

$$\text{[CARRYOVER FAULT] if } Supht_{dis,act}<Supht_{dis,s}$$

A value of $Supht_{dis,act}<Supht_{dis,s}$ indicates that the refrigerant was not fully evaporated prior to compression and that the actual entropy of the refrigerant at the suction of the compressor is less than the expected entropy $s_{suc,exp}$.

In some embodiments, step 410 includes detecting a compressor efficiency fault by comparing the isentropic compressor efficiency $\eta_s$ determined in step 406 with the threshold value $thresh_3$. If the isentropic compressor efficiency $\eta_s$ is less than the threshold value $thresh_3$ (or less than the threshold value $thresh_3$ by more than a predetermined amount), step 410 may include determining that a compressor efficiency fault has been detected. I.e.:

$$\text{[EFFICIENCY FAULT] if } \eta_s<thresh_3$$

Figure 10:
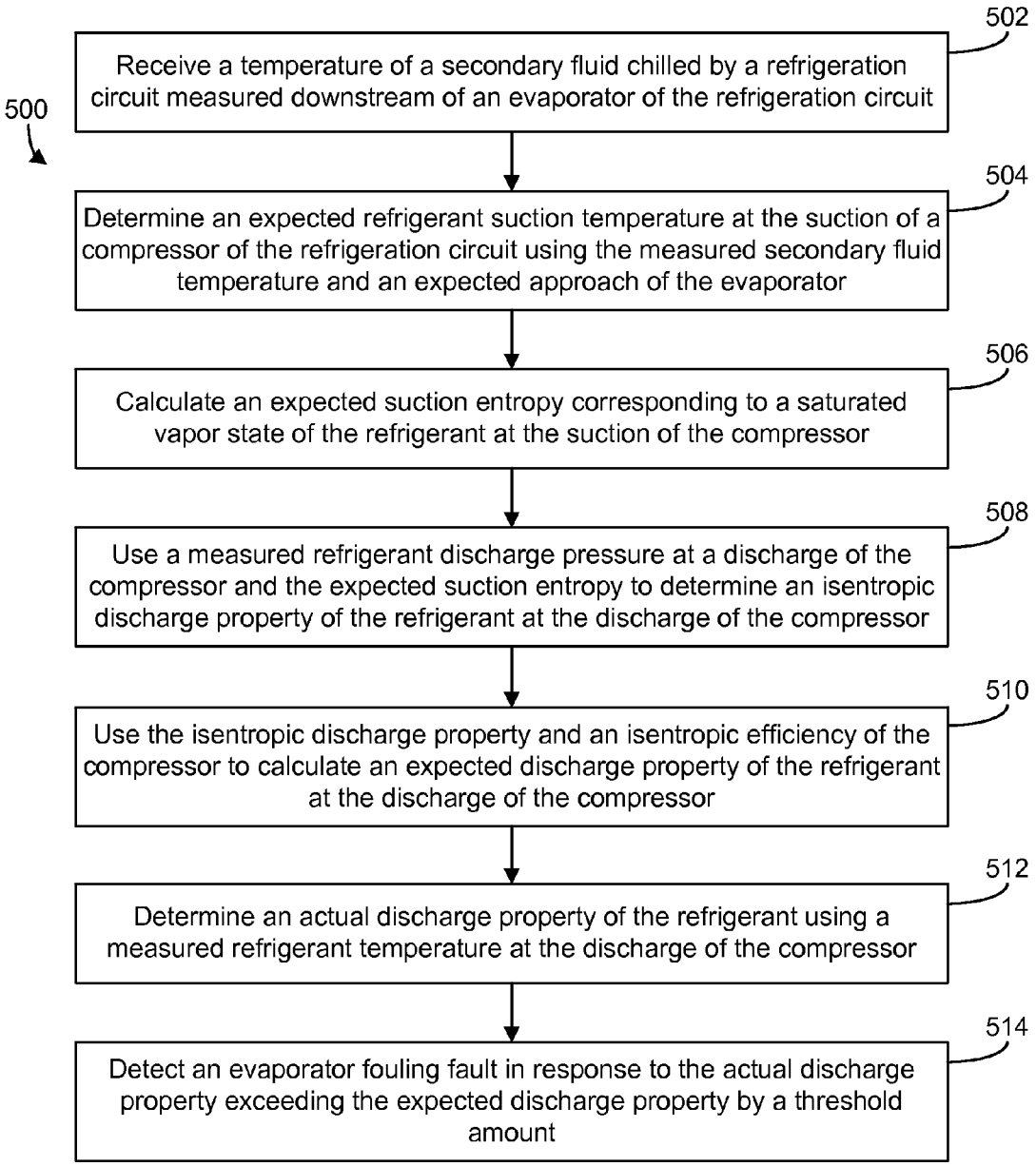
FIG. 10 is a flowchart of a process for detecting and diagnosing an evaporator fouling fault in a refrigeration circuit, according to an exemplary embodiment.

Referring now to FIG. 10, a flowchart of a process 500 for detecting and diagnosing an evaporator fouling fault in a refrigeration circuit is shown, according to an exemplary embodiment. Process 500 may be implemented as a variant of process 400 and may be used to detect and diagnose the evaporator fouling fault specifically. In some embodiments, process 500 is performed by FDD system 200 using various modules of memory 208, as described with reference to FIG. 4.

Process 500 is shown to include receiving a temperature of a secondary fluid chilled by a refrigeration circuit measured downstream of an evaporator of the refrigeration circuit (step 502). The refrigeration circuit (e.g., refrigeration circuit 42 or 84) may have a an evaporator, a condenser, an expansion valve, and a compressor configured to circulate a refrigerant between the evaporator and the condenser, as described with reference to FIGS. 2-3. The refrigeration circuit may absorb heat from the secondary fluid in the evaporator. The temperature of the secondary fluid may be measured by a temperature sensor positioned downstream of the evaporator in a separate chilled fluid circuit. The measured temperature (i.e., $T_{cf}$) may be received at communications interface 202 of FDD system 200 and stored in memory 208 (e.g., in parameter storage module 210) for use in subsequent steps of process 500.

Still referring to FIG. 10, process 500 is shown to include determining an expected refrigerant suction temperature at the suction of a compressor of the refrigeration circuit using the measured secondary fluid temperature and an expected approach of the evaporator (step 504). In some embodiments, step 504 is performed by expected suction state module 216. The expected suction temperature may be calculated in step 504 using the equation:

$$T_{suc,exp}=T_{cf}-EA_{exp}$$

where $EA_{exp}$ is the expected approach for the evaporator and $T_{cf}$ is the temperature of the secondary fluid measured in step 502.

Still referring to FIG. 10, process 500 is shown to include calculating an expected suction entropy corresponding to a saturated vapor state of the refrigerant at the suction of the compressor (step 506). In step 506, the expected suction temperature $T_{suc,exp}$ may be used to calculate the expected suction entropy. For example, the expected entropy $s_{suc,exp}$ may be calculated using the equation:

$$s_{suc,exp}=s_{sat}(T_{suc,exp})$$

where $s_{sat}(\ )$ is a function that returns the saturation entropy of the refrigerant as a function of temperature.

In some embodiments, step 506 includes calculating other expected properties of the refrigerant at the suction of the compressor. For example, step 506 may include determining any expected thermodynamic property of the refrigerant at the suction side of compressor 48 (e.g., enthalpy, internal energy, specific volume, density, pressure, temperature, entropy, etc.) using the state equations stored in state equation module 214.

Still referring to FIG. 10, process 500 is shown to include using a measured refrigerant discharge pressure at a discharge of the compressor and the expected suction entropy to determine an isentropic discharge property of the refrigerant at the discharge of the compressor (step 508). Step 508 may include measuring the pressure $P_{dis,act}$ at the discharge of the compressor. The isentropic discharge property determined in step 508 may result from an ideal isentropic compression of the refrigerant from the expected suction state determined in step 506 to the actual pressure $P_{dis,act}$ at the discharge of the compressor.

The isentropic discharge property determined in step 508 may include an isentropic discharge temperature $T_{dis,s}$, an isentropic discharge enthalpy $h_{dis,s}$, and/or an isentropic discharge entropy $s_{dis,s}$ of the refrigerant at the discharge of the compressor. The isentropic discharge entropy $s_{dis,s}$ is the same as the expected suction entropy $s_{suc,exp}$ for an isentropic compression process:

$$s_{dis,s}=s_{suc,exp}$$

The isentropic discharge temperature $T_{dis,s}$ and the isentropic discharge enthalpy $h_{dis,s}$ may be calculated using the equations:

$$T_{dis,s}=T(P_{dis,act},s_{dis,s})$$

$$h_{dis,s}=h(P_{dis,act},T_{dis,s})$$

where T( ) and h( ) are functions that return the temperature and enthalpy of the refrigerant as a function of two unique thermodynamic properties (e.g., pressure and entropy, pressure and temperature, temperature and entropy, etc.) and $P_{dis,act}$ is the actual discharge pressure measured at the discharge of the compressor.

Still referring to FIG. 10, process 500 is shown to include using the isentropic discharge property and an isentropic efficiency of the compressor to calculate an expected discharge property of the refrigerant at the discharge of the compressor (step 510). In some embodiments, step 510 includes identifying an isentropic efficiency of the compressor. In some embodiments, the isentropic efficiency is provided by a compressor manufacturer and may be retrieved from memory in step 510. In other embodiments, the isentropic efficiency is calculated based on measured values. For example, the isentropic efficiency $\eta_s$ of the compressor may be calculated using the equation:

$$\eta_s = \frac{h_{dis,s} - h_{suc,act}}{h_{dis,act} - h_{suc,act}}$$

where $h_{dis,s}$ is the actual isentropic discharge enthalpy, $h_{suc,act}$ is the actual suction enthalpy, and $h_{dis,act}$ is the actual discharge enthalpy.

Step 510 may include using the expected suction enthalpy, the isentropic discharge enthalpy, and the isentropic efficiency to calculate an expected discharge enthalpy of the refrigerant at the discharge of the compressor. For example, step 510 may include calculating the expected discharge enthalpy $h_{dis,exp}$ using the equation:

$$h_{dis,exp} = \frac{h_{dis,s} - h_{suc,exp}}{\eta_s} + h_{suc,exp}$$

Step 510 may include using the expected discharge enthalpy and the measured discharge pressure to calculate an expected discharge temperature of the refrigerant at the discharge of the compressor. For example, step 510 may include calculating the expected discharge temperature $T_{dis,exp}$ using the following equation:

$$T_{dis,exp}=T(P_{dis,act},h_{dis,exp})$$

In some embodiments, the expected discharge property determined in step 510 is an expected discharge temperature. In other embodiments, the expected discharge property is an expected amount of superheat corresponding to a difference between the expected discharge temperature and a saturation temperature of the refrigerant at a measured discharge pressure. In some embodiments, the expected discharge property is an isentropic discharge property resulting from an ideal isentropic compression of the refrigerant from a saturated vapor at the suction of the compressor to superheated vapor at the discharge of the compressor.

Still referring to FIG. 10, process 500 is shown to include determining an actual discharge property of the refrigerant using a measured refrigerant temperature at the discharge of the compressor (step 512). Step 512 may be performed by actual discharge state module 222, as described with reference to FIG. 4. In some embodiments, the actual discharge property is an actual temperature or an actual pressure measured by a sensor located along a discharge line connecting the discharge of the compressor with the condenser. Step 512 may include calculating an actual entropy $s_{dis,act}$ and/or an actual enthalpy $h_{dis,act}$ of the refrigerant at the discharge of the compressor using the measured temperature $T_{dis,act}$ and the measured pressure $P_{dis,act}$ of the refrigerant at the discharge of the compressor. For example, step 512 may include calculating an actual discharge enthalpy $h_{dis,act}$ using the equation:

$$h_{dis,act}=h(P_{dis,act},T_{dis,act})$$

where $P_{dis,act}$ and $T_{dis,act}$ are the actual pressure and the actual temperature measured at the discharge of the compressor and h( ) is a function that returns the enthalpy of the refrigerant as a function of pressure and temperature.

Step 512 may include calculating an actual amount of superheat of the refrigerant at the discharge of the compressor. The actual amount of superheat may be defined as the difference between the actual temperature $T_{dis,act}$ of the refrigerant at the discharge of the compressor and the saturation temperature $T_{dis,sat}$ of the refrigerant at the discharge pressure $P_{dis,act}$. Step 512 may include calculating the saturation temperature $T_{dis,sat}$ using the equation:

$$T_{dis,sat}=T_{sat}(P_{dis,act})$$

where $T_{sat}$( ) is a function that returns the saturation temperature of the refrigerant as a function of pressure. Once the saturation temperature $T_{dis,sat}$ is determined, step 512 may include calculating the amount of superheat $Supht_{dis,act}$ at the discharge of the compressor using the equation:

$$Supht_{dis,act}=T_{dis,act}-T_{dis,sat}$$

Still referring to FIG. 10, process 500 is shown to include detecting an evaporator fouling fault in response to the actual discharge property exceeding the expected discharge property by a threshold amount (step 514). In some embodiments, step 514 includes comparing the actual measured temperature $T_{dis,act}$ of the refrigerant at the discharge of the compressor with the expected temperature $T_{dis,exp}$ of the refrigerant at the discharge of the compressor. If the measured discharge temperature $T_{dis,act}$ exceeds the expected discharge temperature $T_{dis,exp}$ by a threshold value $thresh_1$, step 514 may include determining that an evaporator fouling fault has been detected. I.e.:

$$\text{[FOULING FAULT] if } T_{dis,act}-T_{dis,exp}>\text{thresh}_1$$

In other embodiments, step 514 includes comparing the actual amount of superheat $Supht_{dis,act}$ of the refrigerant at the discharge of the compressor outlet with the expected amount of superheat $Supht_{dis,exp}$ at the discharge of the compressor based on the expected discharge property. If the actual amount of superheat $Supht_{dis,act}$ exceeds the expected amount of superheat $Supht_{dis,exp}$ by a threshold value $thresh_2$, step 514 may include determining that an evaporator fouling fault has been detected. I.e.:

$$\text{[FOULING FAULT] if } Supht_{dis,act}-Supht_{dis,exp}>\text{thresh}_2$$

Figure 11:
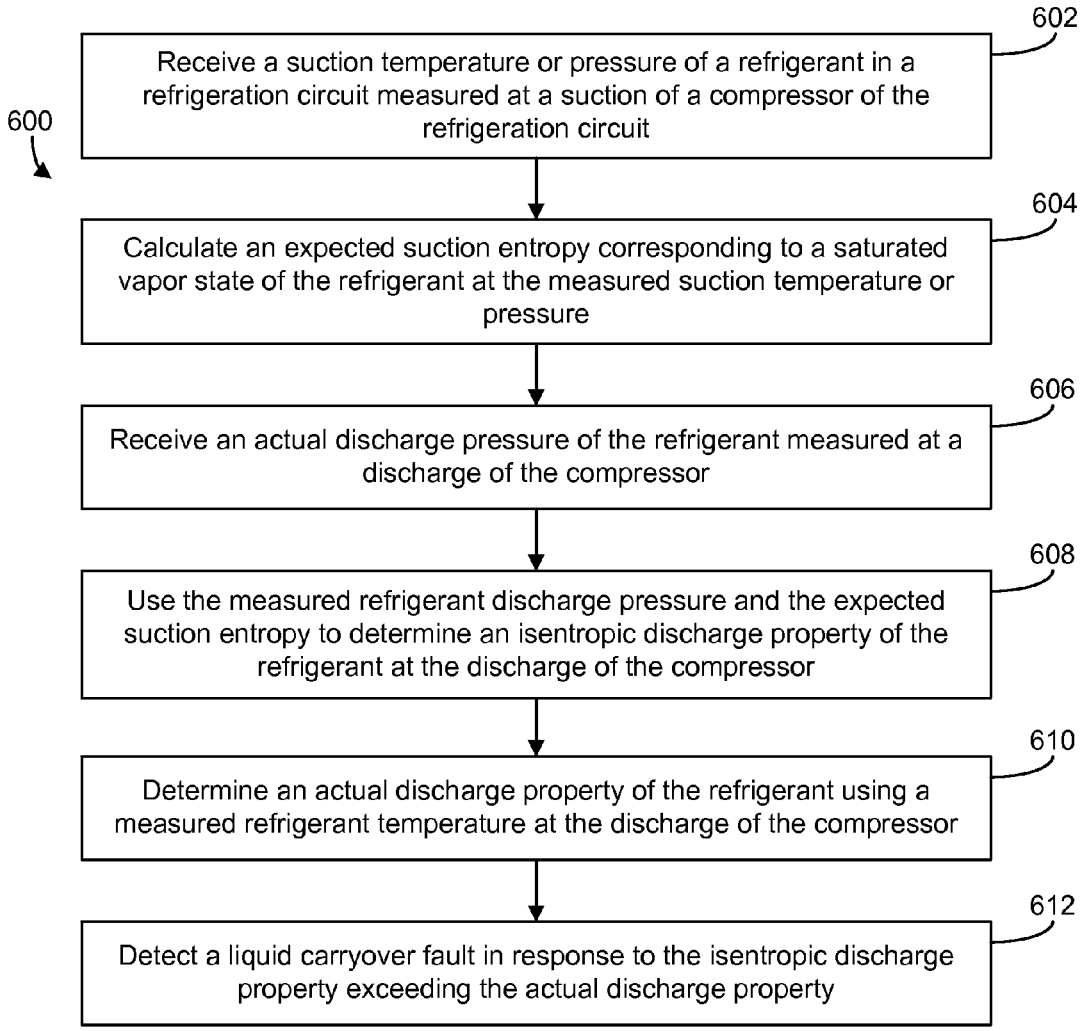
FIG. 11 is a flowchart of a process for detecting and diagnosing a liquid carryover fault in a refrigeration circuit, according to an exemplary embodiment.

Referring now to FIG. 11, a flowchart of a process 600 for detecting and diagnosing a liquid carryover fault in a refrigeration circuit is shown, according to an exemplary embodiment. Process 600 may be implemented as a variant of process 400 and may be used to detect and diagnose the liquid carryover fault specifically. Process 600 may be performed by FDD system 200 using various modules of memory 208, as described with reference to FIG. 4.

Process 600 is shown to include receiving a suction temperature or pressure of a refrigerant in a refrigeration circuit measured at a suction of a compressor of the refrigeration circuit (step 602). In some embodiments, step 602 is performed by sensor input module 212. The refrigeration circuit (e.g., refrigeration circuit 42 or 84) may have an evaporator, a condenser, an expansion valve, and a compressor configured to circulate a refrigerant between the evaporator and the condenser, as described with reference to FIGS. 2-3. The temperature or pressure received in step 602 may be measured by a temperature sensor or pressure sensor located along a suction line connecting the evaporator and the compressor and may be received at communications interface 202 of FDD system 200.

Still referring to FIG. 11, process 600 is shown to include calculating an expected suction entropy corresponding to a saturated vapor state of the refrigerant at the measured suction temperature or pressure (step 604). Step 604 may include calculating the expected suction entropy $s_{suc,exp}$ using the equations:

$$T_{suc,exp}=T_{sat}(P_{suc,act})$$

$$s_{suc,exp}=s_{sat}(T_{suc,exp})$$

where $P_{suc,act}$ is the actual suction pressure of the refrigerant at the suction of the compressor, $T_{sat}$( ) is a function that returns the saturation temperature of the refrigerant as a function of pressure, and $s_{sat}$( ) is a function that returns the saturation entropy of the refrigerant as a function of temperature. The expected suction entropy calculated in step 604 may correspond to the entropy of a saturated vapor refrigerant at the measured suction pressure.

In some embodiments, step 604 includes calculating other expected properties of the refrigerant at the suction of the compressor. For example, step 604 may include determining any expected thermodynamic property of the refrigerant at the suction side of the compressor (e.g., enthalpy, internal energy, specific volume, density, pressure, temperature, entropy, etc.) using the state equations stored in state equation module 214.

Still referring to FIG. 11, process 600 is shown to include receiving an actual discharge pressure of the refrigerant measured at a discharge of the compressor (step 606) and using the measured refrigerant discharge pressure and the expected suction entropy to determine an isentropic discharge property of the refrigerant at the discharge of the compressor (step 608). Step 606 may include measuring the pressure $P_{dis,act}$ at the discharge of the compressor. The isentropic discharge property determined in step 608 may result from an ideal isentropic compression of the refrigerant from the expected suction state characterized in step 604 to the actual pressure $P_{dis,act}$ at the discharge of the compressor.

Step 608 may include calculating an isentropic discharge temperature $T_{dis,s}$, an isentropic discharge enthalpy $h_{dis,s}$, and/or an isentropic discharge entropy $s_{dis,s}$ of the refrigerant at the discharge of the compressor. The isentropic discharge entropy $s_{dis,s}$ is the same as the expected suction entropy $s_{suc,exp}$ for an isentropic compression process:

$$s_{dis,s}=s_{suc,exp}$$

The isentropic discharge temperature $T_{dis,s}$ and the isentropic discharge enthalpy $h_{dis,s}$ may be calculated using the equations:

$$T_{dis,s}=T(P_{dis,act},s_{dis,s})$$

$$h_{dis,s}=h(P_{dis,act},T_{dis,s})$$

where T( ) and h( ) are functions that return the temperature and enthalpy of the refrigerant as a function of two unique thermodynamic properties (e.g., pressure and entropy, pressure and temperature, temperature and entropy, etc.) and $P_{dis,act}$ is the actual discharge pressure measured at the discharge of the compressor.

In some embodiments, step 608 includes using the isentropic discharge property and an isentropic compressor efficiency to determine an expected discharge property of the refrigerant at the discharge of the compressor. For example, step 608 may include calculating the expected discharge enthalpy $h_{dis,exp}$ using the equation:

$$h_{dis,exp} = \frac{h_{dis,s} - h_{suc,exp}}{\eta_s} + h_{suc,exp}$$

Still referring to FIG. 11, process 600 is shown to include determining an actual discharge property of the refrigerant using a measured refrigerant temperature at the discharge of the compressor (step 610). Step 610 may be performed by actual discharge state module 222, as described with reference to FIG. 4. In some embodiments, the actual discharge property is an actual temperature or an actual pressure measured by a sensor located along a discharge line connecting the discharge of the compressor with the condenser. Step 610 may include calculating an actual entropy $s_{dis,act}$ and/or an actual enthalpy $h_{dis,act}$ of the refrigerant at the discharge of the compressor using the measured temperature $T_{dis,act}$ and the measured pressure $P_{dis,act}$ of the refrigerant at the discharge of the compressor. For example, step 610 may include calculating an actual discharge enthalpy $h_{dis,act}$ using the equation:

$$h_{dis,act}=h(P_{dis,act}, T_{dis,act})$$

where $P_{dis,act}$ and $T_{dis,act}$ are the actual pressure and the actual temperature measured at the discharge of the compressor and h( ) is a function that returns the enthalpy of the refrigerant as a function of pressure and temperature.

Step 610 may include calculating an actual amount of superheat of the refrigerant at the discharge of the compressor. The actual amount of superheat may be defined as the difference between the actual temperature $T_{dis,act}$ of the refrigerant at the discharge of the compressor and the saturation temperature $T_{dis,sat}$ of the refrigerant at the discharge pressure $P_{dis,act}$. Step 610 may include calculating the saturation temperature $T_{dis,sat}$ using the equation:

$$T_{dis,sat}=T_{sat}(P_{dis,act})$$

where $T_{sat}$( ) is a function that returns the saturation temperature of the refrigerant as a function of pressure. Once the saturation temperature $T_{dis,sat}$ is determined, step 610 may include calculating the amount of superheat $Supht_{dis,act}$ at the discharge of the compressor using the equation:

$$Supht_{dis,act}=T_{dis,act}-T_{dis,sat}$$

Still referring to FIG. 11, process 600 is shown to include detecting a liquid carryover fault in response to the isentropic discharge property exceeding the actual discharge property (step 612). In some embodiments, the liquid carryover fault is detected by comparing the measured temperature $T_{dis,act}$ of the refrigerant at the discharge of the compressor with the isentropic discharge temperature $T_{dis,s}$ calculated in step 608. If the measured discharge temperature $T_{dis,act}$ is less than the isentropic discharge temperature $T_{dis,s}$, step 612 may include determining that the liquid carryover fault has been detected. I.e.:

[CARRYOVER FAULT] if $T_{dis,act}<T_{dis,s}$

A value of $T_{dis,act}<T_{dis,s}$ indicates that the refrigerant was not fully evaporated prior to compression and that the actual entropy of the refrigerant at the suction of the compressor is less than the expected entropy $s_{suc,exp}$.

In other embodiments, step 612 includes detecting the liquid carryover fault by comparing an amount of superheat $Supht_{dis,act}$ of the refrigerant at the compressor outlet with a threshold value. The threshold value may be, for example, an expected amount of superheat $Supht_{dis,s}$ resulting from an isentropic compression from the suction pressure $P_{suc,act}$ to the discharge pressure $P_{dis,act}$ when the refrigerant enters the compressor as a saturated vapor. If the actual amount of superheat $Supht_{dis,act}$ is less than the threshold value $Supht_{dis,s}$, step 612 may include determining that the liquid carryover fault has been detected. I.e.:

[CARRYOVER FAULT] if $Supht_{dis,act}<Supht_{dis,s}$

A value of $Supht_{dis,act}<Supht_{dis,s}$ indicates that the refrigerant was not fully evaporated prior to compression and that the actual entropy of the refrigerant at the suction of the compressor is less than the expected entropy $s_{suc,exp}$.

In some embodiments, step 612 includes detecting the liquid carryover fault by comparing the actual discharge property (e.g., the actual discharge enthalpy, the actual amount of superheat, etc.) with an expected value for the discharge property rather than an isentropic value. The expected value for the discharge property may be calculated using the isentropic suction property and an isentropic compressor efficiency, as described with reference to step 608. Step 612 may include detecting the liquid carryover fault in response to the expected discharge property exceeding the actual value.

Figure 12:
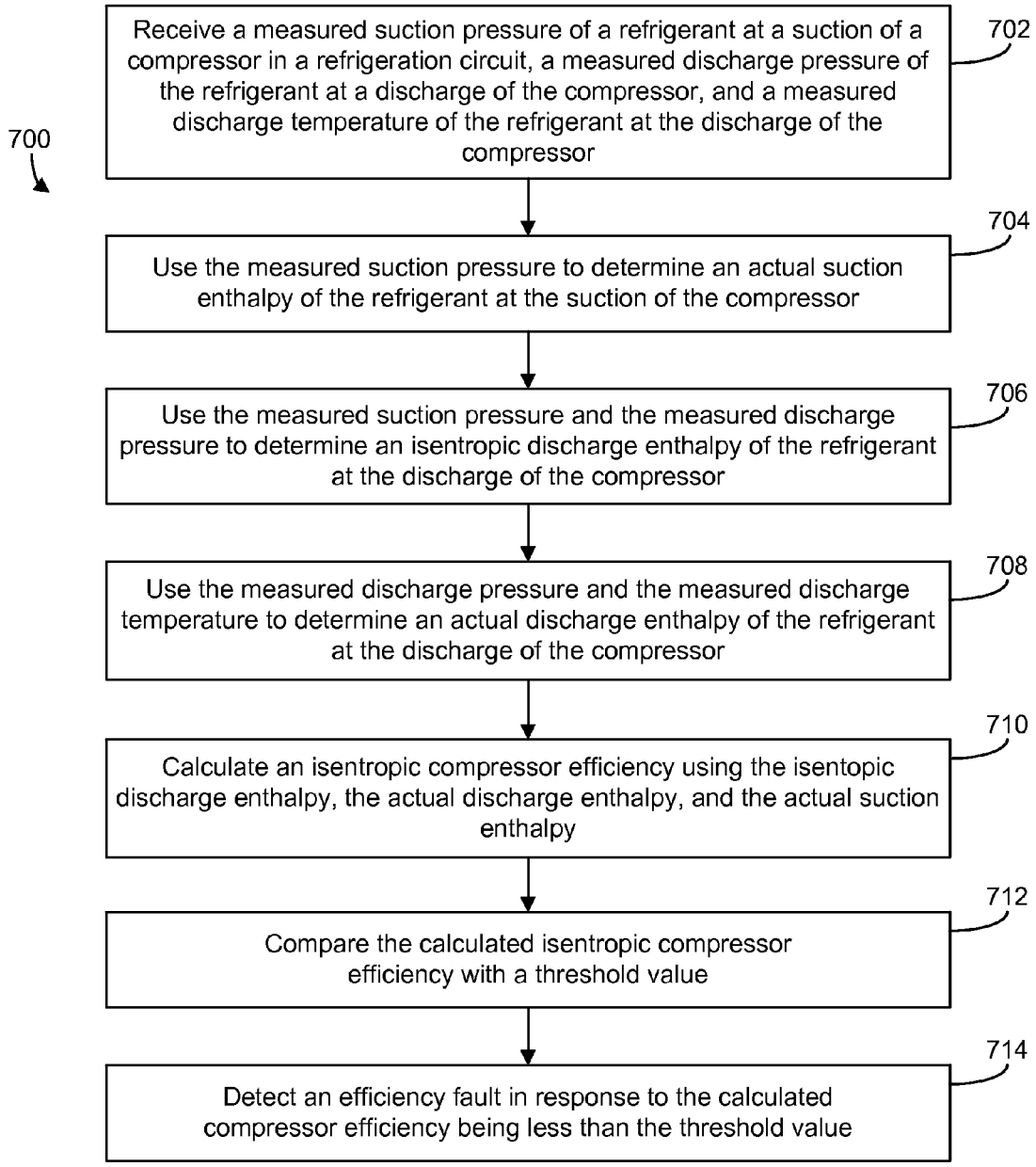
FIG. 12 is a flowchart of a process for detecting and diagnosing a compressor efficiency fault in a refrigeration circuit, according to an exemplary embodiment.

Referring now to FIG. 12, a flowchart of a process 700 for detecting and diagnosing a compressor efficiency fault in a refrigeration circuit is shown, according to an exemplary embodiment. Process 700 may be implemented as a variant of process 400 and may be used to detect and diagnose the compressor efficiency fault specifically. Process 700 may be performed by FDD system 200 using various modules of memory 208, as described with reference to FIG. 4.

Process 700 is shown to include receiving a measured suction pressure of a refrigerant at a suction of a compressor in a refrigeration circuit, a measured discharge pressure of the refrigerant at a discharge of the compressor, and a measured discharge temperature of the refrigerant at the discharge of the compressor (step 702). In some embodiments, step 702 is performed by sensor input module 212. The refrigeration circuit (e.g., refrigeration circuit 42 or 84) may have an evaporator, a condenser, an expansion valve, and a compressor configured to circulate a refrigerant between the evaporator and the condenser, as described with reference to FIGS. 2-3. The suction pressure $P_{suc,act}$ received in step 702 may be measured by a pressure sensor located along a suction line connecting the evaporator and the compressor. The discharge pressure $P_{dis,act}$ and the discharge temperature $T_{dis,act}$ received in step 702 may be measured by a pressure sensor and temperature sensor, respectively, located along a discharge line connecting the compressor to a condenser of the refrigeration circuit. The measured values may be received at communications interface 202 of FDD system 200.

Still referring to FIG. 12, process 700 is shown to include using the measured suction pressure to determine an actual suction enthalpy of the refrigerant at the suction of the compressor (step 704). In some embodiments, step 704 is performed by actual suction state module 218, as described with reference to FIG. 4. For example, step 704 may include using the measured pressure $P_{suc,act}$ of the refrigerant at the suction of the compressor as an input to an equation that calculates the actual suction enthalpy $h_{suc,act}$ as a function of the measured suction pressure $P_{suc,act}$. In some embodiments, step 704 includes assuming that the refrigerant is a saturated vapor (i.e., quality=1) at the suction of the compressor. For example, step 704 may include calculating an actual suction enthalpy $h_{suc,act}$ using the equation:

$$h_{suc,act}=h_{sat}(P_{suc,act})$$

where $h_{sat}(\ )$ is a function that returns saturation enthalpy of the refrigerant at a particular pressure provided as an input.

In some embodiments, step 704 includes calculating an actual suction entropy $s_{suc,act}$ of the refrigerant at the suction of the compressor using the equation:

$$s_{suc,act}=s_{sat}(P_{suc,act})$$

where $s_{sat}(\ )$ is a function that returns the saturation entropy at a particular pressure provided as an input. In other embodiments, step 704 includes calculating the actual suction entropy $s_{suc,act}$ and/or the actual suction enthalpy $h_{suc,act}$ as a function of a measured temperature $T_{suc,act}$ of the refrigerant at a suction of the compressor. Any combination of thermodynamic properties and/or assumptions that define a thermodynamic state may be used to determine the actual suction enthalpy and/or actual suction entropy in various embodiments.

Still referring to FIG. 12, process 700 is shown to include using the measured suction pressure and the measured discharge pressure to determine an isentropic discharge enthalpy of the refrigerant at the discharge of the compressor (step 706). In some embodiments, step 706 is performed by isentropic discharge state module 220, as described with reference to FIG. 4. For example, step 706 may include determining the isentropic discharge entropy $s_{dis,s}$. Since the compression is assumed to be isentropic, the isentropic discharge entropy $s_{dis,s}$ is the same as the suction entropy $s_{suc,act}$ calculated in step 704. I.e.:

$$s_{dis,s}=s_{suc,act}$$

Step 706 may include calculating the isentropic discharge enthalpy $h_{dis,s}$ using the isentropic discharge entropy $s_{dis,s}$ and the measured discharge pressure $P_{dis,act}$. For example, step 706 may include calculating the isentropic discharge enthalpy $h_{dis,s}$ using the equations:

$$T_{dis,s}=T(P_{dis,act},s_{dis,s})$$

$$h_{dis,s}=h(P_{dis,act},T_{dis,s})$$

where T( ) is a function that returns a temperature of the refrigerant as a function of pressure and entropy, h( ) is a function that returns an enthalpy of the refrigerant as a function of pressure and temperature, and $P_{dis,act}$ is the measured discharge pressure received in step 702.

Still referring to FIG. 12, process 700 is shown to include using the measured discharge pressure and the measured discharge temperature to determine an actual discharge enthalpy of the refrigerant at the discharge of the compressor (step 708). In some embodiments, step 708 is performed by actual discharge state module 222, as described with reference to FIG. 4. For example, step 708 may include calculating the actual discharge enthalpy $h_{dis,act}$ using the equation:

$$h_{dis,act}=h(P_{dis,act},T_{dis,act})$$

where $P_{dis,act}$ and $T_{dis,act}$ are the measured discharge pressure and the measured discharge temperature received in step 702 and h( ) is a function that returns the enthalpy of the refrigerant as a function of pressure and temperature.

Process 700 is shown to include calculating an isentropic compressor efficiency using the isentropic discharge enthalpy, the actual discharge enthalpy, and the actual suction enthalpy (step 710). In some embodiments, step 710 includes calculating the isentropic compressor efficiency $\eta_s$ using the following equation:

$$\eta_s=\frac{h_{dis,s}-h_{suc,act}}{h_{dis,act}-h_{suc,act}}$$

where $h_{dis,s}$, $h_{suc,act}$, and $h_{dis,act}$ are the values for the isentropic discharge enthalpy, actual suction enthalpy, and actual discharge enthalpy, respectively, determined in steps 704-708.

Still referring to FIG. 12, process 700 is shown to include comparing the calculated compressor efficiency with a threshold value (step 712) and detecting an efficiency fault in response to the calculated compressor efficiency being less than the threshold value (step 714). The threshold value $thresh_3$ may be a previously-determined compressor efficiency, a manufacturer-provided compressor efficiency, or another benchmark against which $\eta_s$ can be compared. If the isentropic compressor efficiency $\eta_s$ determined in step 710 is less than the threshold value $thresh_3$ (or less than the threshold value $thresh_3$ by more than a predetermined amount), step 714 may include determining that a compressor efficiency fault has been detected. I.e.:

$$\text{[EFFICIENCY FAULT] if } \eta_s<thresh_3$$

Figure 13:
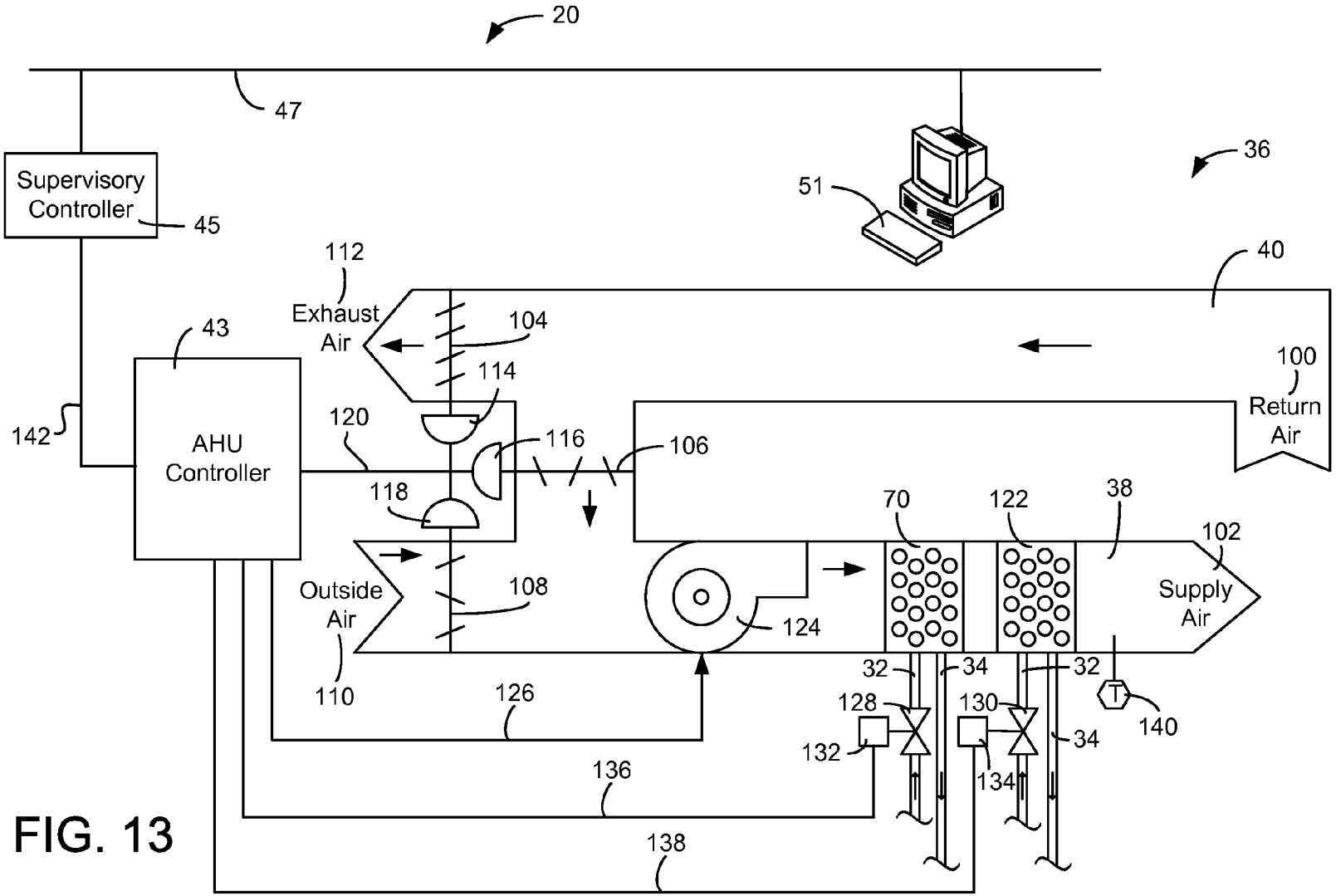
FIG. 13 is a block diagram illustrating another portion of the HVAC system of FIG. 1 in greater detail, according to an exemplary embodiment.

Referring now to FIG. 13, a block diagram of an air handling unit (AHU) 36 is shown, according to an exemplary embodiment. FIG. 13 illustrates an exemplary setting in which the systems and methods of the present disclosure can be implemented. For example, the refrigeration circuit described above may operate to chill a fluid used by AHU 36 to provide cooling for a building. AHU 36 is shown as an economizer-type air handling unit. Economizer-type air handling units vary the amount of outside air and return air used by the air handling unit for heating or cooling. For example, AHU 36 may receive return air 100 from building 10 via return air duct 40 and may deliver supply air 102 to building 10 via supply air duct 38. AHU 36 may be configured to operate exhaust air damper 104, mixing damper 106, and outside air damper 108 to control an amount of outside air 110 and return air 100 that combine to form supply air 102. Any return air 100 that does not pass through mixing damper 106 may be exhausted from AHU 36 through exhaust damper 104 as exhaust air 112.

Each of dampers 104-108 may be operated by an actuator. As shown in FIG. 13, exhaust air damper 104 may be operated by actuator 114, mixing damper 106 may be operated by actuator 116, and outside air damper 108 may be operated by actuator 118. Actuators 114-118 may communicate with an AHU controller 43 via a communications link 120. AHU controller 43 may be an economizer controller configured to use one or more control algorithms (e.g., state-based algorithms, ESC algorithms, PID control algorithms, model predictive control algorithms, feedback control algorithms, etc.) to control actuators 114-118.

Actuators 114-118 may receive control signals from AHU controller 43 and may provide feedback signals to AHU controller 43. Feedback signals may include, for example, an indication of a current actuator or damper position, an amount of torque or force exerted by the actuator, diagnostic information (e.g., results of diagnostic tests performed by actuators 114-118), status information, commissioning information, configuration settings, calibration data, and/or other types of information or data that may be collected, stored, or used by actuators 114-118.

Still referring to FIG. 13, AHU 36 is shown to include a cooling coil 70, a heating coil 122, and a fan 124. In some embodiments, cooling coil 70, heating coil 122, and fan 124 are positioned within supply air duct 38. Fan 124 may be configured to force supply air 102 through cooling coil 70 and/or heating coil 122. AHU controller 43 may communicate with fan 124 via communications link 126 to control a flow rate of supply air 102. Cooling coil 70 may receive a chilled fluid from chiller 22 via piping 32 and may return the chilled fluid to chiller 22 via piping 34. Valve 128 may be positioned along piping 32 or piping 34 to control an amount of the chilled fluid provided to cooling coil 70. Heating coil 122 may receive a heated fluid from boiler 24 via piping 32 and may return the heated fluid to boiler 24 via piping 34. Valve 130 may be positioned along piping 32 or piping 34 to control an amount of the heated fluid provided to heating coil 122.

Each of valves 128-130 may be controlled by an actuator. As shown in FIG. 13, valve 128 may be controlled by actuator 132 and valve 130 may be controlled by actuator 134. Actuators 132-134 may communicate with AHU controller 43 via communications links 136-138. Actuators 132-134 may receive control signals from AHU controller 43 and may provide feedback signals to controller 43. In some embodiments, AHU controller 43 receives a measurement of the supply air temperature from a temperature sensor 140 positioned in supply air duct 38 (e.g., downstream of cooling coil 70 and heating coil 122). However, temperature sensor 140 is not required and may not be included in some embodiments.

AHU controller 43 may operate valves 128-130 via actuators 132-134 to modulate an amount of heating or cooling provided to supply air 102 (e.g., to achieve a setpoint temperature for supply air 102 or to maintain the temperature of supply air 102 within a setpoint temperature range). The positions of valves 128-130 affect the amount of heating or cooling provided to supply air 102 by cooling coil 70 or heating coil 122 and may correlate with the amount of energy consumed to achieve a desired supply air temperature. In various embodiments, valves 128-130 may be operated by AHU controller 43 or a separate controller for HVAC system 20.

Still referring to FIG. 13, HVAC system 20 is shown to include a supervisory controller 45 and a client device 51. Supervisory controller 45 may include one or more computer systems (e.g., servers, BAS controllers, etc.) that serve as system level controllers, application or data servers, head nodes, master controllers, or field controllers for HVAC system 20. Supervisory controller 45 may communicate with multiple downstream building systems or subsystems (e.g., an HVAC system, a security system, etc.) via a communications link 142 according to like or disparate protocols (e.g., LON, BACnet, etc.).

In some embodiments, AHU controller 43 receives information (e.g., commands, setpoints, operating boundaries, etc.) from supervisory controller 45. For example, supervisory controller 45 may provide AHU controller 43 with a high fan speed limit and a low fan speed limit. A low limit may avoid frequent component and power taxing fan startups while a high limit may avoid operation near the mechanical or thermal limits of the fan system. In various embodiments, AHU controller 43 and supervisory controller 45 may be separate (as shown in FIG. 13) or integrated. In an integrated implementation, AHU controller 43 may be a software module configured for execution by a processor of supervisory controller 45.

Client device 51 may include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 20, its subsystems, and/or devices. Client device 51 may be a computer workstation, a client terminal, a remote or local interface, or any other type of user interface device. Client device 51 may be a stationary terminal or a mobile device. For example, client device 51 may be a desktop computer, a computer server with a user interface, a laptop computer, a tablet, a smartphone, a PDA, or any other type of mobile or non-mobile device. Client device 51 may communicate with supervisory controller 45, AHU controller 43, and/or controllers 44 and 86 via communications link 142 and/or network 47.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A fault detection and diagnostics (FDD) system comprising:

a refrigeration circuit comprising an evaporator and a compressor configured to circulate a refrigerant through the evaporator;

a communications interface configured to receive a measurement of a thermodynamic property affected by the refrigeration circuit; and a processing circuit having a processor and memory, wherein the processing circuit is configured to:

use the measured thermodynamic property to determine an expected suction entropy of the refrigerant at a suction of the compressor;

use the expected suction entropy to determine an expected thermodynamic discharge property of the refrigerant at a discharge of the compressor;

determine an actual thermodynamic discharge property of the refrigerant at the discharge of the compressor; and detect a fault in the refrigeration circuit by comparing the expected thermodynamic discharge property with the actual thermodynamic discharge property.

2. The FDD system of claim 1, wherein:

the refrigerant absorbs heat from a secondary fluid in the evaporator; and the measured thermodynamic property is a measured temperature of the secondary fluid downstream of the evaporator.

3. The FDD system of claim 2, wherein determining the expected suction entropy comprises:

using the measured temperature of the secondary fluid and an expected approach of the evaporator to determine an expected suction temperature of the refrigerant at the suction of the compressor; and calculating the expected suction entropy corresponding to a saturated vapor state of the refrigerant at the expected suction temperature.

4. The FDD system of claim 3, wherein:

the communications interface is configured to receive a measured discharge pressure of the refrigerant at the discharge of the compressor; and determining the expected thermodynamic discharge property comprises using the measured discharge pressure and the expected suction entropy to calculate an expected isentropic discharge temperature of the refrigerant at the discharge of the compressor.

5. The FDD system of claim 4, wherein determining the expected thermodynamic discharge property comprises:

calculating an expected suction enthalpy corresponding to a saturated vapor state of the refrigerant at the expected suction temperature;

using the isentropic discharge temperature and the measured discharge pressure to calculate an isentropic discharge enthalpy of the refrigerant at the discharge of the compressor.

6. The FDD system of claim 5, wherein determining the expected thermodynamic discharge property comprises:

identifying an isentropic efficiency of the compressor; and using the expected suction enthalpy, the isentropic discharge enthalpy, and the isentropic efficiency to calculate an expected discharge enthalpy of the refrigerant at the discharge of the compressor.

7. The FDD system of claim 6, wherein determining the expected thermodynamic discharge property comprises:

using the expected discharge enthalpy and the measured discharge pressure to calculate an expected discharge temperature of the refrigerant at the discharge of the compressor.

8. The FDD system of claim 1, wherein:

the expected thermodynamic discharge property is an expected discharge temperature;

the actual thermodynamic discharge property is a measured discharge temperature; and detecting the fault in the refrigeration circuit comprises comparing the expected discharge temperature with the measured discharge temperature.

9. The FDD system of claim 1, wherein:

the expected thermodynamic discharge property is an expected amount of superheat corresponding to a difference between an expected discharge temperature of the refrigerant and a saturation temperature of the refrigerant at a measured discharge pressure;

the actual thermodynamic discharge property is an actual amount of superheat corresponding to a difference between a measured discharge temperature of the refrigerant and the saturation temperature of the refrigerant at the measured discharge pressure; and detecting the fault in the refrigeration circuit comprises comparing the expected amount of superheat with the actual amount of superheat.

10. The FDD system of claim 1, wherein detecting the fault in the refrigeration circuit comprises:

calculating an amount by which the actual thermodynamic discharge property exceeds the expected thermodynamic discharge property;

comparing the calculated amount with a threshold value; and determining that an evaporator fouling fault is detected in response to the calculated amount exceeding the threshold value.

11. The FDD system of claim 1, wherein:

the measured thermodynamic property is a measured suction temperature or pressure of the refrigerant at the suction of the compressor; and determining the expected suction entropy comprises calculating an expected entropy corresponding to a saturated vapor state of the refrigerant at the measured suction temperature or pressure.

12. The FDD system of claim 11, wherein:

the expected thermodynamic discharge property is an isentropic discharge property resulting from an ideal isentropic compression of the refrigerant from a saturated vapor at the suction of the compressor to superheated vapor at the discharge of the compressor;

the actual discharge property is based on a measured discharge temperature and a measured discharge pressure of the refrigerant at the discharge of the compressor; and detecting the fault in the refrigeration circuit comprises comparing the isentropic discharge property with the actual discharge property.

13. The FDD system of claim 12, wherein detecting the fault in the refrigeration circuit comprises determining that a liquid carryover fault is detected in response to the isentropic discharge property exceeding the actual discharge property.

14. A fault detection and diagnostics (FDD) system comprising:

a refrigeration circuit comprising an evaporator and a compressor configured to circulate a refrigerant through the evaporator;

one or more sensors positioned to measure a thermodynamic property of the refrigerant at a suction of the compressor and a thermodynamic property of the refrigerant at a discharge of the compressor; and a processing circuit having a processor and memory, wherein the processing circuit is configured to:

use the measured thermodynamic properties to calculate enthalpy values comprising an actual suction enthalpy of the refrigerant at the suction of the compressor, an actual discharge enthalpy of the refrigerant at the discharge of the compressor, and an isentropic discharge enthalpy of the refrigerant at the discharge of the compressor;

use the calculated enthalpy values to calculate an isentropic efficiency of the compressor;

identify a threshold isentropic efficiency of the compressor; and detect a fault in the refrigeration circuit by comparing the calculated isentropic efficiency with the threshold isentropic efficiency.

15. The FDD system of claim 14, wherein the thermodynamic properties measured by the one or more sensors comprise:

a measured suction temperature or pressure of the refrigerant at the suction of the compressor;

a measured discharge pressure of the refrigerant at the discharge of the compressor; and a measured discharge temperature of the refrigerant at the discharge of the compressor.

16. The FDD system of claim 15, wherein calculating the isentropic efficiency of the compressor comprises:

calculating a suction enthalpy and a suction entropy corresponding to a saturated vapor state of the refrigerant at the measured suction temperature or pressure;

using the suction entropy and the measured discharge pressure to calculate an isentropic discharge enthalpy at the discharge of the compressor; and using the measured discharge pressure and the measured discharge temperature to calculate an actual discharge enthalpy at the discharge of the compressor.

17. The FDD system of claim 16, wherein calculating the isentropic efficiency of the compressor comprises:

determining a first amount by which the isentropic discharge enthalpy exceeds the suction enthalpy;

determining a second amount by which the actual discharge enthalpy exceeds the suction enthalpy; and dividing the first amount by the second amount.

18. A method for detecting and diagnosing faults in a refrigeration circuit, the method comprising:

operating a compressor of the refrigeration circuit to circulate a refrigerant through an evaporator of the refrigeration circuit receiving, at a processing circuit, a measurement of a thermodynamic property affected by the refrigeration circuit;

using the measured thermodynamic property to determine, by the processing circuit, an expected suction entropy of the refrigerant at a suction of the compressor;

using the expected suction entropy of the refrigerant at the suction of the compressor to determine, by the processing circuit, an expected thermodynamic discharge property of the refrigerant at a discharge of the compressor;

determining, by the processing circuit, an actual thermodynamic discharge property of the refrigerant at the discharge of the compressor; and detecting, by the processing circuit, a fault in the refrigeration circuit by comparing the expected thermodynamic discharge property with the actual thermodynamic discharge property.

19. The method of claim 18, wherein detecting the fault in the refrigeration circuit comprises:

calculating an amount by which the actual thermodynamic discharge property exceeds the expected thermodynamic discharge property;

comparing the calculated amount with a threshold value; and determining that an evaporator fouling fault is detected in response to the calculated amount exceeding the threshold value.

20. The method of claim 18, wherein:

determining the expected thermodynamic discharge property comprises calculating an isentropic discharge property resulting from an ideal isentropic compression of the refrigerant from a saturated vapor at the suction of the compressor to a superheated vapor at the discharge of the compressor;

determining the actual discharge property comprises using a measured discharge temperature of the refrigerant at the discharge of the compressor;

detecting the fault in the refrigeration circuit comprises determining that a liquid carryover fault is detected in response to the isentropic discharge property exceeding the actual discharge property.

* * * * *